US010678154B2

(12) United States Patent
Takashima et al.

(10) Patent No.: US 10,678,154 B2
(45) Date of Patent: Jun. 9, 2020

(54) ELECTROPHOTOGRAPHIC ELECTROCONDUCTIVE MEMBER, PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Kenji Takashima, Numazu (JP); Kazuhiro Yamauchi, Suntou-gun (JP); Masahiro Kurachi, Susono (JP); Yuichi Kikuchi, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 63 days.

(21) Appl. No.: 15/698,018

(22) Filed: Sep. 7, 2017

(65) Prior Publication Data

US 2018/0088476 A1 Mar. 29, 2018

(30) Foreign Application Priority Data

Sep. 27, 2016 (JP) ..... 2016-188486

(51) Int. Cl.

| | |
|---|---|
| ***G03G 5/14*** | (2006.01) |
| ***G03G 15/02*** | (2006.01) |
| *G03G 15/08* | (2006.01) |
| *G03G 15/16* | (2006.01) |

(52) U.S. Cl.

CPC ..... *G03G 5/144* (2013.01); *G03G 5/142* (2013.01); *G03G 15/0233* (2013.01); *G03G 15/0818* (2013.01); *G03G 15/1685* (2013.01)

(58) Field of Classification Search

None

See application file for complete search history.

(56) References Cited

U.S. PATENT DOCUMENTS

| | | | | |
|---|---|---|---|---|
| 7,799,398 | B2 | 9/2010 | Nakamura et al. | |
| 8,298,670 | B2 | 10/2012 | Muranaka et al. | |
| 8,449,975 | B2 | 5/2013 | Hirakoso et al. | |
| 8,503,916 | B2 | 8/2013 | Anan et al. | |
| 8,628,854 | B2 | 1/2014 | Yamauchi et al. | |
| 8,660,472 | B2 * | 2/2014 | Kurachi | G03G 15/0818 399/286 |
| 8,715,830 | B2 | 5/2014 | Yamada et al. | |

(Continued)

FOREIGN PATENT DOCUMENTS

| | | | | |
|---|---|---|---|---|
| JP | 2015-68985 | A | 4/2015 | |
| WO | WO-2015045377 | A1 * | 4/2015 | G03G 15/0233 |

OTHER PUBLICATIONS

U.S. Appl. No. 15/543,656, filed Jul. 14, 2017, Yuichi Kikuchi.

(Continued)

*Primary Examiner* — Arrie L Reuther

(74) *Attorney, Agent, or Firm* — Venable LLP

(57) ABSTRACT

An electrophotographic electroconductive member which keeps high discharge performance even in use under a high temperature and high humidity environment is provided. The electroconductive member includes an electroconductive substrate, and a surface layer including a net-like structural body disposed on the electroconductive substrate, wherein the net-like structural body includes non-electroconductive fibers containing a radiation degradable resin.

13 Claims, 3 Drawing Sheets

(56) References Cited

U.S. PATENT DOCUMENTS

| | | | | |
|---|---|---|---|---|
| 8,771,818 | B2 | 7/2014 | Nishioka et al. | |
| 8,852,743 | B2 | 10/2014 | Kikuchi et al. | |
| 9,023,465 | B2 | 5/2015 | Yamada et al. | |
| 9,086,643 | B2 | 7/2015 | Kikuchi et al. | |
| 9,128,403 | B2 | 9/2015 | Yamauchi et al. | |
| 9,146,482 | B2 | 9/2015 | Watanabe et al. | |
| 9,360,789 | B1 | 6/2016 | Masu et al. | |
| 9,442,408 | B2 | 9/2016 | Yamauchi et al. | |
| 9,442,451 | B2 | 9/2016 | Yamauchi et al. | |
| 9,541,854 | B2 | 1/2017 | Kikuchi et al. | |
| 9,547,250 | B2 | 1/2017 | Kikuchi et al. | |
| 9,551,949 | B2 | 1/2017 | Yamauchi et al. | |
| 9,556,359 | B2 | 1/2017 | Suzumura et al. | |
| 9,581,931 | B2 | 2/2017 | Yamada et al. | |
| 9,599,913 | B2 | 3/2017 | Nishioka et al. | |
| 9,639,009 | B2 | 5/2017 | Yamaguchi et al. | |
| 9,651,888 | B2 | 5/2017 | Muranaka et al. | |
| 9,665,028 | B2 | 5/2017 | Arimura et al. | |
| 9,665,029 | B2 | 5/2017 | Hino et al. | |
| 9,740,133 | B2 * | 8/2017 | Yamauchi ..... | G03G 15/0233 |
| 9,811,009 | B2 | 11/2017 | Yamada et al. | |
| 9,811,021 | B2 | 11/2017 | Muranaka et al. | |
| 2012/0308261 | A1 | 12/2012 | Tsuru et al. | |
| 2013/0281276 | A1 | 10/2013 | Watanabe et al. | |
| 2014/0072343 | A1 | 3/2014 | Masu et al. | |
| 2014/0080691 | A1 | 3/2014 | Kurachi et al. | |
| 2015/0093151 | A1 * | 4/2015 | Muranaka ..... | G03G 15/0291 399/176 |
| 2015/0198900 | A1 | 7/2015 | Yamada et al. | |
| 2015/0198906 | A1 * | 7/2015 | Yamauchi ..... | G03G 15/0233 492/18 |
| 2015/0331340 | A1 | 11/2015 | Nishioka et al. | |
| 2015/0331342 | A1 | 11/2015 | Yamaguchi et al. | |
| 2015/0331346 | A1 | 11/2015 | Yamauchi et al. | |
| 2015/0331347 | A1 | 11/2015 | Arimura et al. | |
| 2016/0154323 | A1 | 6/2016 | Nishioka et al. | |
| 2016/0187801 | A1 | 6/2016 | Yamada et al. | |
| 2016/0187809 | A1 | 6/2016 | Yamaguchi et al. | |
| 2017/0210719 | A1 | 7/2017 | Nishioka et al. | |

OTHER PUBLICATIONS

U.S. Appl. No. 15/702,075, filed Sep. 12, 2017, Yuichi Kikuchi.
U.S. Appl. No. 15/789,124, filed Oct. 20, 2017, Hiroki Masu.
Kenichi Shinohara et. al. "Hoshasen to Kobunshi", 1968, published by Maki Shoten, pp. 89 to 95. (Discussed at specification paragraph [0042].

* cited by examiner

ELECTROPHOTOGRAPHIC ELECTROCONDUCTIVE MEMBER, PROCESS CARTRIDGE, AND ELECTROPHOTOGRAPHIC IMAGE FORMING APPARATUS

BACKGROUND OF THE INVENTION

Field of the Invention

The present invention relates to electrophotographic electroconductive members, process cartridges, and electrophotographic image forming apparatuses.

Description of the Related Art

In electrophotographic image forming apparatuses which are image forming apparatuses employing electrophotography, electroconductive members are used in a variety of applications, such as electroconductive rollers such as charging rollers, developing rollers, and transfer rollers. These electroconductive rollers should be controlled to have appropriate values of electric resistance independently environments in use. To control the conductivity of the electroconductive layer, the electroconductive rollers include an electroconductive layer containing an electronically electroconductive agent represented by carbon black or an ionically electroconductive agent such as a quaternary ammonium salt compound. If the electroconductive roller is a charging roller, a charging roller having a resistance out of an appropriate range unstabilizes the discharging from the charging roller to the photosensitive member, and may locally generate excess discharge, generating image defects. To solve the problem, Japanese Patent Application Laid-Open No. 2015-68985 discloses an electroconductive member including an electroconductive support layer and a net-like structural body disposed thereon and including fine non-electroconductive fibers.

Recent electrophotographic image forming apparatuses have been more and more required to have a higher speed and a longer life. The present inventors, who have conducted extensive research, have found that use of the electroconductive member according to Japanese Patent Application Laid-Open No. 2015-68985 as a charging roller effectively reduces abnormal discharge through a finer discharge and enhances the discharging ability attributed to surface charge up caused by insulation and a large surface area.

Unfortunately, if the electroconductive member is used under a high temperature and high humidity environment at a temperature of 30° C. and a relative humidity of 80%, for example, the discharging ability may gradually reduce in some cases. Similarly, if the electroconductive member is used as a transfer roller, continuous use thereof under a high temperature and high humidity environment for a long time may gradually reduce the discharging ability in some cases. As above, the electrophotographic electroconductive rollers such as charging rollers and transfer rollers are susceptible to improvement because continuous use of these rollers at a high speed for a long time under a high temperature and high humidity environment reduces the discharging ability.

SUMMARY OF THE INVENTION

One aspect of the present invention is directed to providing an electroconductive member which can stably keep the discharging ability even in use under a high temperature and high humidity environment. Another aspect of the present invention is also directed to providing a process cartridge and an electrophotographic image forming apparatus which can form high-quality electrophotographic images.

According to one aspect of the present invention, there is provided an electrophotographic electroconductive member including an electroconductive substrate, and a surface layer including a net-like structural body disposed on the electroconductive substrate, wherein the net-like structural body includes non-electroconductive fibers containing a radiation degradable resin.

According to another aspect of the present invention, there is provided a method of producing an electrophotographic electroconductive member including forming a surface layer including the net-like structural body by electrospinning.

According to another aspect of the present invention, there is provided a process cartridge configured to be detachably attachable to the body of an electrophotographic image forming apparatus, and including the electrophotographic electroconductive member.

According to further another aspect of the present invention, there is provided an electrophotographic image forming apparatus including the electrophotographic electroconductive member.

Further features of the present invention will become apparent from the following description of exemplary embodiments with reference to the attached drawings.

DESCRIPTION OF THE EMBODIMENTS

Figure 1A:
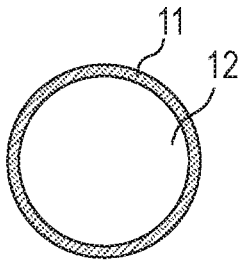
FIG. 1A and FIG. 1B are sectional views illustrating examples of the electrophotographic electroconductive members according to the present invention.

Preferred embodiments of the present invention will now be described in detail in accordance with the accompanying drawings.

(Electrophotographic Electroconductive Member)

The electrophotographic electroconductive member (hereinafter, also referred to as electroconductive member) according to one aspect of the present invention has electroconductive substrate, and a surface layer including a net-like structural body disposed on the electroconductive substrate. The net-like structural body includes non-electroconductive fibers containing a radiation degradable resin. The present inventors have found that the electroconductive member has a stable discharging behavior, keeps a more stable discharging state for a long time, and effectively reduces image defects caused by insufficient charging. To verify the maintenance of the stable discharging, the photosensitive member was charged with the electroconductive member according to the present invention to measure the charging potential of the surface of the photosensitive member under a high temperature and a high humidity. As a result, it was verified that the generation of image defects attributed to abnormal discharge can be reduced, and a reduced potential can be prevented even in use for a long time.

In discharge for charging in an electrophotographic field, a high voltage of hundreds to thousands volts is applied to the charging member. The size of the discharge generated between the charging member and its charging member to be charged disposed in contact with the charging member is about 1 $mm^2$ at most. For this reason, significantly large energy is locally applied to the surface of the charging member during discharging.

Accordingly, if the electroconductive member described in Japanese Patent Application Laid-Open No. 2015-68985 is used as the charging member, the fibers forming the surface of the electroconductive member receive significantly large energy per unit area.

The present inventors have found that when the fibers receive large energy, the fibers show different behaviors to the radiations according to the difference in properties of the resin forming the fibers. In other words, it was found that if high voltage is applied to an electroconductive member including non-electroconductive fibers containing a radiation degradable resin and including a surface layer including a net-like structural body for a long time, the degradation of the fibers is reduced. In this specification, the term "discharge degradation" indicates a phenomenon where the charging performance of the charging member reduces with use. The term "reduction in discharge degradation" indicates that the charging performance of the charging member is unlikely to reduce even in use, and a reduction in charging quantity of the charging member to be charged is prevented.

The charging member to be charged such as a photosensitive member is charged by the following mechanism. A voltage is applied to the electroconductive member; then, the surface thereof discharges, and the charge having the same symbol (minus or plus) as that of the applied voltage travels to the surface of the charging member to be charged along the electric field. In contrast, the charge having the opposite polarity (plus or minus) travels to the surface layer. At this time, because the surface layer is non-electroconductive, the surface layer captures the charge to charge up (in this specification, this charge is referred to as charge-up charge). A reduction in charge-up charge results in a reduced charge quantity of the side of its counterpart charging member to be charged or a reduced charging quantity, generating discharge degradation.

It is considered that the electroconductive member according to one aspect of the present invention reduces the discharge degradation for the following reason. If discharging energy is continuously applied to the fibers forming the net-like structural body, part of bonds such as carbon-hydrogen in the polymer skeleton in the molecular chemical structure cleaves to generate radicals. These radical moieties usually react with oxygen and water present in the air to take oxygen into the chemical structure, and thus oxidation proceeds. And/or these radicals form new bonds with other radicals present around the molecule to generate by-products. Particularly, the oxidation is promoted under high temperature and high humidity conditions to increase the amount of the by-products to be generated. A high temperature increases the mobility of the resin molecules to promote the reaction with the surrounding molecules, and a high humidity increases water molecules to promote oxidation. The promoted oxidation and the by-products reduce the resistance of the net-like structural body. A reduction in non-conductivity of the surface layer including the net-like structural body leads to leakage of the charge-up charge to the electroconductive substrate to inhibit the charge-up, generating the discharge degradation.

In contrast, the non-electroconductive fibers forming the net-like structural body in the electroconductive member according to the present invention contain a radiation degradable resin, and generates significantly unstable radicals. For this reason, the radicals migrate on the main chain skeleton of the polymer, causing molecular cleavage to cleave the main chain skeleton during the migration. The molecular cleavage readily occurs near the skeleton terminals. The cleavage, if caused, terminates the radical reaction of the main skeleton after the cleavage (skeleton having a longer molecular chain). The skeleton separated from the main skeleton after the cleavage (skeleton having a significantly reduced length) is further decomposed by a further reaction, and disappears because of conversion to a gas. Then, the entire radical reaction is terminated. The main skeleton after the cleavage has a slightly reduced molecular weight. Except for this, there is no significant change compared to the polymer skeleton structure, and thus the discharging ability is kept. Because the reaction from the generation of radicals to the termination of the reaction instantaneously occurs, oxidation is unlikely to proceed irrespective of the condition on usage, reducing the generation of the by-products. As a result, the charge-up charge and the charge of the charging member to be charged are kept without reducing the non-conductivity of the surface layer including the net-like structural body, and the discharge degradation is reduced.

For such reasons, it is considered that the electroconductive member according to the present invention reduces changes in the materials after discharge for a long time even under a high temperature and high humidity environment, reducing the discharge degradation. The present invention will now be described in detail. Hereinafter, the electrophotographic electroconductive member will be described by way of a representative charging member, but the applications of the electroconductive member according to the present invention will not be limited to the charging member.

Figure 1B:
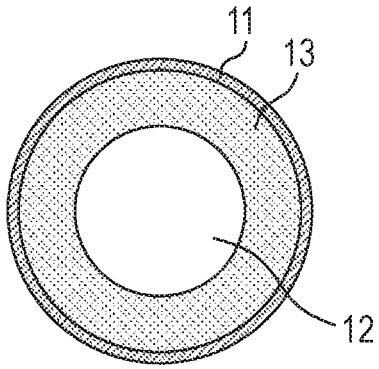

The electroconductive member according to the present invention includes an electroconductive substrate, and a surface layer disposed thereon and including a net-like structural body. FIG. 1A and FIG. 1B illustrate examples of the electroconductive members according to the present invention. For example, as illustrated in FIG. 1A, the electroconductive member according to the present invention can include an electroconductive mandrel 12 as an electroconductive substrate, and a surface layer 11 including a net-like structural body disposed on the outer periphery thereof. For example, as illustrated in FIG. 1B, the electroconductive member according to the present invention can include an electroconductive mandrel 12 as an electroconductive substrate, an electroconductive resin layer 13 disposed on the outer periphery thereof, and furthermore, a surface layer 11 disposed on the outer periphery thereof and including a net-like structural body. The electroconductive member may have a multi-layer configuration having a plurality of electroconductive resin layers 13, when necessary, within the range not inhibiting the effect of one aspect according to the present invention.

As illustrated in FIG. 1A, the electroconductive member according to the present invention can include the electroconductive mandrel 12 as the electroconductive substrate, and the surface layer 11 disposed on the outer periphery thereof and including the net-like structural body. In application of energy during discharge, a configuration not including the electroconductive resin layer can prevent the generation of the by-products by the interface reaction, and therefore facilitates the demonstration of the effect of the present invention.

<Electroconductive Substrate>

As described above, the electroconductive substrate may include an electroconductive mandrel, or may include an electroconductive mandrel and an electroconductive resin layer disposed on the outer periphery thereof. The electroconductive substrate according to the present invention can include a rigid structural body from the viewpoint of the stabilization of the shape.

[Electroconductive Mandrel]

The electroconductive mandrel can be appropriately selected from known electroconductive mandrels in the field of the electrophotographic electroconductive member for use. A metal mandrel can be used. Examples thereof include a cylinder including a carbon steel alloy having a surface nickel plated in a thickness of about 5 μm. In the energy during discharge is partially converted into thermal energy, a metal mandrel having high thermal conductivity facilitates dissipation of thermal energy, reducing damage to the electroconductive member and enhancing the durability thereof.

[Electroconductive Resin Layer]

The electroconductive resin layer can be formed of a rubber material or a resin material. Any known rubber material in the field of the electrophotographic electroconductive member can be used without limitation. Examples thereof specifically include the following rubber materials: epichlorohydrin homopolymer, epichlorohydrin-ethylene oxide copolymer, epichlorohydrin-ethylene oxide-allyl glycidyl ether terpolymer, acrylonitrile-butadiene copolymer, and hydrogenated product of acrylonitrile-butadiene copolymer; and silicone rubber, acrylic rubber, and urethane rubber. Any known resin material in the field of the electrophotographic electroconductive member can be used. Specifically, examples thereof include polyurethane, polyamides, polyesters, polyolefins, epoxy resins, and silicone resins. These materials may be used singly or in combinations of two or more.

Among these materials forming the electroconductive resin layer, acrylonitrile rubber can be used. This is because if the material is acrylonitrile rubber, the non-electroconductive fibers forming the net-like structural body according to the present invention have low reactivity, and are unlikely to cause the generation of the by-products and the accompanying discharge degradation even under application of energy during discharge.

The material for forming the electroconductive resin layer can be compounded with an electronically electroconductive agent or an ionically electroconductive agent when necessary to control the value of the electric resistance. Examples of the electronically electroconductive agent include carbon black and graphite having electron conductivity; oxides such as tin oxide; metals such as copper and silver; and electroconductive particles having surfaces coated with an oxide or a metal to have conductivity. Examples of the ionically electroconductive agent include ionically electroconductive agents having ion exchange performance such as quaternary ammonium salts and sulfonates having ionic electroconductivity. These electroconductive agents may be used singly or in combinations of two or more.

Fillers, softening agents, processing aids, tackifiers, anti-tack agents, dispersants, foaming agents, and roughening particles usually used as the compounding agents for the resin can also be added in the range not impairing the effect of one aspect according to the present invention.

As a measure of the value of the electric resistance of the electroconductive resin layer, the volume resistivity can be $1\times10^3$ Ω·cm or more and $1\times10^9$ Ω·cm or less, for example. It is verified that the surface layer including the net-like structural body according to the present invention can reduce the image defects attributed to excessive discharge even in the case of a sufficiently low value of electric resistance of the electroconductive substrate.

<Surface Layer Including Net-Like Structural Body>

The surface layer including the net-like structural body can have the following configuration from the viewpoint of preventing abnormal discharge and keeping discharge stability even in use for a long time.

[Properties of Non-Electroconductive Fibers in Surface Layer Including Net-Like Structural Body]

The surface layer including the net-like structural body includes non-electroconductive fibers containing a radiation degradable resin. The surface layer including the net-like structural body may include non-electroconductive fibers. The non-electroconductive fibers may contain a radiation degradable resin. In the radiation degradable resin, the molecular chains more readily cleave through irradiation with radiation rays, rather than a crosslinking reaction. Use of the non-electroconductive fibers containing the radiation degradable resin according to the present invention reduces discharge degradation as described above. On the other hand, examples of a resin having a strong tendency to have a molecular structure enlarged by newly formed bonds through molecular crosslinking, etc., rather than irradiation with radiation rays, include radiation crosslinking resins. These radiation crosslinking resins generate stable radicals to increase opportunities of a reaction with surrounding oxygen, water, etc., thus promoting oxidation or generation of by-products. Accordingly, the resistance decreases during discharge, causing discharge degradation. Particularly under a high temperature and a high humidity, resin molecules have increased mobility to promote the reaction with their surrounding molecules. It should be noted that the resin material used as fibers in Examples of Japanese Patent Application Laid-Open No. 2015-68985 is a radiation crosslinking resin, which causes discharge degradation.

Examples of the radiation degradable resin can be found, for example, in pp. 89 to 95 of "Hoshasen to Kobunshi" written by Kenichi Shinohara et. al. (1968, published by Maki Shoten).

In the present invention, whether a resin corresponds to the radiation degradable resin can be determined by measurement of the molecular weight before and after the treatment of the application of radiation rays or equivalent energy to examine the difference. For example, the target resin is subjected to corona discharge, and is analyzed by measurement by gel permeation chromatography (GPC). In the GPC measurement, the target resin is dissolved in a solvent to prepare a solution. In this step, a solvent which dissolves the target resin most easily can be appropriately selected from toluene, tetrahydrofuran (THF), trifluoroacetic acid, 1,1,1,3,3,3-hexafluoro-2-propanol (HFIP), and formic acid.

The solution is subjected to the GPC measurement to measure the resin component dissolved in the solution. A resin having a molecular weight equal to or less than the molecular weight before the corona discharge treatment indicates that the cleavage of the molecular skeleton occurs preferentially, and is determined as a radiation degradable resin. On the other hand, a resin having an increased molecular weight is determined as a radiation crosslinking resin.

The radiation degradable resin preferably has a glass transition temperature of 50° C. or more and 200° C. or less. The glass transition temperature is more preferably 80° C. or more and 200° C. or less, still more preferably 100° C. or more and 150° C. or less. A glass transition temperature of 50° C. or more and 200° C. or less prevents a change in the net-like structure caused by a change in shapes of the fibers to keep the discharging ability even in the application of large energy for a long time by discharge in the form of thermal energy. Within this range, a higher glass transition temperature more significantly prevents the change of the structure. Particularly, a glass transition temperature of 80° C. or more minimizes the change in the net-like structure such as the change in the shape of the fibers to keep the discharging ability even under application of higher discharge energy or higher voltage to the side of the electroconductive member. At a glass transition temperature of less than 50° C., the molecular motion may be active even at room temperature; in this case, the shapes of fibers may change by application of discharge energy to reduce the surface area, causing discharge degradation. On the other hand, at a glass transition temperature of more than 200° C., while the net-like structure has an increased hardness near room temperature, the net-like structure may become fragile due to microfibers forming the net-like structure, causing breakage of the net-like structure with slight stress applied. As a result, stable discharge cannot be maintained for a long time in some cases.

The glass transition temperature of the resin contained in the non-electroconductive fibers contained in the surface layer including the net-like structural body can be measured as follows: The surface layer including the net-like structural body is recovered from the electroconductive member with a pair of tweezers, etc., and is measured by differential scanning calorimetry (DSC), for example. The DSC measurement may also be performed after the surface layer including the net-like structural body is recovered from the electroconductive member, is melted by heating or with a solvent, and is formed into a sheet.

The radiation degradable resin having a glass transition temperature in this range can be an acrylic resin having a structural unit represented by formula (1): Formula (1)

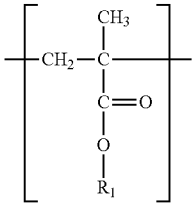

(1)

wherein $R_1$ represents a hydrocarbon group having 1 to 6 carbon atoms. $R_1$ is preferably a hydrocarbon group having 2 to 6 carbon atoms, more preferably a linear or branched alkyl group having 2 to 6 carbon atoms. If $R_1$ is a linear or branched alkyl group having 2 to 6 carbon atoms, $R_1$ does not have a cyclic structure, and therefore prevents formation of stable radicals due to resonance, etc. $R_1$ has a plurality of carbons to increase steric hindrance and thus decrease the opportunities of the reaction with the discharge products at this moiety, preventing oxidation. Moreover, $R_1$ can particularly be at least one selected from the group consisting of groups represented by formulas (2) to (5):

$$—C(CH_3)_3 \quad \text{Formula (2)}$$

$$—CH(CH_3)_2 \quad \text{Formula (3)}$$

$$—CH(CH_3)—C(CH_3)_3 \quad \text{Formula (4)}$$

$$—C(CH_3)_2—CH(CH_3)_2 \quad \text{Formula (5)}$$

If $R_1$ is at least one selected from the group consisting of groups represented by Formulas (2) to (5), $R_1$ has no secondary carbon atom, which readily becomes a radical, and has large steric hindrance to prevent oxidation. Particularly, $R_1$ can be $—C(CH_3)_3$. If $R_1$ is $—C(CH_3)_3$, $R_1$ has quaternary and primary carbon atoms without a tertiary carbon atom. Such a structure more significantly inhibits formation of stable radicals, reducing the discharge degradation caused by oxidation. If $R_1$ has 7 or more carbon atoms, $R_1$ has a larger number of moieties which can be turned into radicals during discharge. Such a group may promote oxidation by a reaction with surrounding oxygen and water and formation of by-products in some cases.

Examples of the acrylic resin having a structural unit represented by Formula (1) specifically include poly(methyl methacrylate), poly(ethyl methacrylate), poly(propyl methacrylate), poly(isopropyl methacrylate), poly(butyl methacrylate), poly(tertiary butyl methacrylate), poly(isobutyl methacrylate), and poly(benzyl methacrylate). Further examples of the acrylic resin having a structural unit represented by Formula (1) includes a copolymer prepared from a combination of two or more monomers of the aforementioned specific acrylic resins.

A possible reaction mechanism in use of an acrylic resin having a structural unit represented by Formula (1) as the radiation degradable resin will be described by way of Formula (a) below. In Formula (a), n represents a repetition number, and a dot represents a radical. Energy applied though discharge dissociates a hydrogen atom in a methyl group bonding to the main chain polymer skeleton to generate a radical. The radical is readily generated near the terminal of the skeleton. The generated radical is very unstable under an influence of the ester bond having electron drawing action. For this reason, the radical will migrate to another moiety in the next reaction. At this time, the radical migrates in the direction of the main chain skeleton because of the influence of the ester bond. The bond is cleaved between the quaternary carbon atom bonding to the methyl group and its adjacent carbon in the direction of the main chain skeleton, and the adjacent carbon becomes a radical, causing molecular cleavage. After molecular cleavage, the main skeleton and a skeleton having a very short molecular chain are generated. The reaction is terminated in the side of the main skeleton, and the radical is left in the side of the skeleton having a short molecular chain. The skeleton having the radical is further decomposed by a further reaction. The radical disappears because of conversion to a gas. Then, the entire radical reaction is terminated. In other words, even if unstable radicals are generated, the reaction is quickly terminated; it is considered, for this reason, that the opportunity to react with surrounding oxygen and water is further reduced, preventing oxidation.

Formula (a)

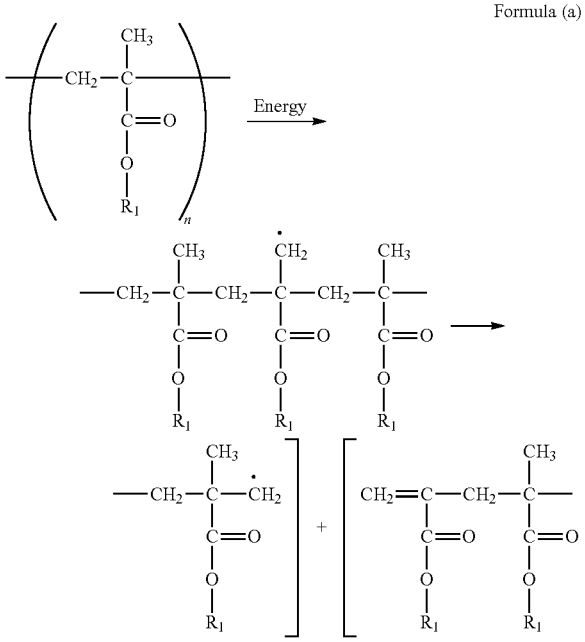

The radiation degradable resin can be a crystalline resin having a melting point of 50° C. or more and 350° C. or less. The melting point is preferably 100° C. or more and 350° C. or less, more preferably 150° C. or more and 350° C. or less. Because the crystalline resin also has amorphous moieties, the resin had better to have a high glass transition temperature. However, if the resin having a low glass transition temperature has crystallinity and has a melting point of 50° C. or more and 350° C. or less, the shapes of the crystalline moieties are kept even after application of thermal energy by discharge to reduce the change in the net-like structure and keep the discharging ability. Particularly, influences by the amorphous moieties can be almost neglected in a resin having a melting point of 150° C. or more. At a melting point of more than 350° C., while the net-like structure has an increased hardness near room temperature, the net-like structure may become fragile due to microfibers forming the net-like structure, causing breakage of the net-like structure with slight stress applied. As a result, stable discharge cannot be maintained for a long time in some cases.

The melting point can be measured by differential scanning calorimetry (DSC) or thermal weight-differential thermal analysis (TG-DTA). Whether the resin has crystallinity can be determined from the melting point clearly observed or a crystal peak appearing in X-ray diffraction analysis (XRD).

Among these radiation degradable resins having crystallinity, at least one selected from the group consisting of a polysaccharide, a polysaccharide derivative, and polyacetal can be used. A polysaccharide indicates a polymerized substance of a plurality of monosaccharide molecules through glycosidic bonds. A polysaccharide derivative indicates a substance having a molecular structure including a glycosidic bond and a monosaccharide molecular skeleton, and having a functional group partially introduced or an atom substituted in moieties other than the glycosidic bond and the monosaccharide molecular skeleton. In a polysaccharide, a polysaccharide derivative, and polyacetal, the main chain skeleton of the molecular structure regularly contains a C—O—C bond of carbon and oxygen atoms, and has repeating units formed through the C—O—C bond. For this reason, when a radical is generated and then the reaction proceeds, any of the C—O bonds is easily cleaved to terminate the reaction. As a result, the time for the entire reaction is shortened, preventing the progression of oxidation.

The polysaccharide and the polysaccharide derivative can be cellulose and a cellulose derivative, respectively. The cellulose and cellulose derivative have a methyl group in the quaternary carbon atom, and have a tertiary carbon atom adjacent to the quaternary carbon atom. For this reason, the energy applied through discharge generates a radical on the methyl group, which migrates to the tertiary carbon atom, or generates a radical directly on the tertiary carbon atom to immediately cause molecular cleavage of the glycosidic bond. Particularly because the structural units are alternately bonded to each other through the glycosidic bond, the reaction described above selectively progresses irrespective of how the energy is applied. Accordingly, the reaction time is further shortened, reducing the discharge degradation due to oxidation.

Among these radiation degradable resins having crystallinity, particularly cellulose acetate can be used. Partial or complete substitution of hydroxy groups by acetyl groups inhibits generation of radicals in these moieties to accelerate the migration of the radical causing the molecular cleavage of the glycosidic bond, thus reducing the discharge degradation due to oxidation.

Among these radiation degradable resins having crystallinity, polyacetal can be used. The polyacetal has no bulky functional group, and the energy applied by discharge concentrates on the molecule main chain skeleton. As a result, the time needed for the molecular cleavage is shortened, further inhibiting oxidation.

The net-like structural body may contain a radical scavenger in addition to the non-electroconductive fibers. Addition of the radical scavenger results in quick termination of the radical reaction during generation of a radical by application of discharge energy. For this reason, the opportunities of the molecular cleavage are reduced to suppress a reduction in molecular weight. The radical scavenger can be an antioxidant having an effect to prevent generation of a peroxide through air oxidation, such as p-hydroquinone or 3,5-dibutyl-4-hydroxytoluene. The amount of the radical scavenger to be added can be 10% by mass or less relative to the radiation degradable resin. An amount thereof to be added within this range can reduce the influences of the radical scavenger on the mechanical strength of the net-like structural body, achieving only the effect of reducing the discharge degradation.

The radiation degradable resin has a weight average molecular weight (Mw) of preferably 50000 or more and 2500000 or less, more preferably 150000 or more and 2500000 or less, still more preferably 300000 or more and 2500000 or less. A resin having a weight average molecular weight of 50000 or more and 2500000 or less has hardness derived from such a high molecular weight. For this reason, the net-like structure is unlikely to change even in use for a long time, and stable discharge can be kept. Particularly a resin having a weight average molecular weight of 150000 or more prevents breakage of the net-like structure even if a charging member containing the resin is used for a long time while in contact with another member The weight average molecular weight can be determined as follows: The surface layer including the net-like structural body is recovered from the electroconductive member with a pair of tweezers, and is measured by microsampling mass spectrometry (μ-MS) or gel permeation chromatography analysis (GPC), for example. Microsampling mass spectrometry may be performed after the surface layer including the net-like structural body is recovered from the electroconductive member, is melted by heating or with a solvent, and is formed into a sheet.

The net-like structural body may further contain a resin having a low molecular weight Mw of less than 50000 in addition to the high molecular weight resin as the radiation degradable resin. As described above, application of energy through discharge readily generates radicals near the terminal of the molecular skeleton, and thus molecular cleavage near the terminal. The low molecular weight resin added has a larger number of terminals in the molecular skeleton than those of the high molecular weight resin (matrix resin) mainly forming the net-like structural body. For this reason, application of energy through discharge results in selective molecular cleavage on the molecular skeleton of the low molecular weight resin added. Thus, the molecular cleavage of the resin mainly forming the net-like structural body can be prevented, keeping the molecular structure and further reducing the discharge degradation. The low molecular weight resin can have a weight average molecular weight of 10000 or less from the viewpoint of enhancing the effect of reducing the discharge degradation. The low molecular weight resin can have the same repeating unit as that of the matrix resin. This is because the compatibility between the low molecular weight resin and the matrix resin is enhanced to homogeneously disperse the low molecular weight resin in the net-like structural body. The content of the low molecular weight resin can be 10% by mass or less relative to the matrix resin. A content within this range reduces the influences of the low molecular weight resin over the mechanical strength of the net-like structural body, achieving only the effect of reducing the discharge degradation.

The non-electroconductive fibers indicate fibers having a volume resistivity of $1\times10^{8}$ Ω·cm or more. The volume resistivity is preferably $1\times10^{8}$ to $1\times10^{16}$ Ω·cm, more preferably $1\times10^{11}$ to $1\times10^{16}$ Ω·cm, still more preferably $1\times10^{13}$ to $1\times10^{16}$ Ω·cm.

At a volume resistivity of less than $1\times10^{8}$ Ω·cm, charge-up charge leaks to the electroconductive substrate to inhibit charge up, causing discharge degradation. A volume resistivity within this range may result in local concentration of the discharge energy in the fibers in some cases; if the discharge energy is converted into thermal energy, the fibers are thermally broken to cause discharge degradation. On the other hand, a volume resistivity of $1\times10^{8}$ Ω·cm or more reduces discharge degradation without leakage of the charge-up charge to the electroconductive substrate. A volume resistivity within this range also inhibits the generation of unexpected abnormal discharge originating from discharge from the surface layer including the net-like structural body itself, preventing local concentration of the discharge energy in the fibers and thus discharge degradation.

A volume resistivity of $1\times10^{16}$ Ω·cm or less reduces discharge failure attributed to the increased resistance of the surface layer including the net-like structural body. At a volume resistivity of $1\times10^{8}$ Ω·cm or more, the non-electroconductive fibers according to the present invention may contain 0.1 to 5 parts by mass of an ionically electroconductive agent relative to 100 parts by mass of the radiation degradable resin. A volume resistivity of $1\times10^{11}$ Ω·cm or more also can sufficiently prevent unexpected abnormal discharge from the surface layer including the net-like structural body. Furthermore, at a volume resistivity of $1\times10^{13}$ Ω·cm or more, almost no unexpected abnormal discharge from the surface layer including the net-like structural body is found.

The volume resistivity of the non-electroconductive fiber can be measured by the following method. The surface layer including the net-like structural body is recovered with the electroconductive member using a pair of tweezers. A cantilever of a scanning probe microscope (SPM) is brought into contact with a single fiber to sandwich the single fiber between the cantilever and the electroconductive substrate. The volume resistivity can be thereby measured. Alternatively, the surface layer including the net-like structural body is recovered from the electroconductive member, is melted by heating or with a solvent, and is formed into a sheet. The volume resistivity may also be measured using the sheet.

A reduction in volume resistance of the electroconductive member is prevented even after discharge treatment is performed for a long time under high temperature and high humidity conditions. For this reason, the charging ability of the surface layer including the net-like structural body is kept, and thus the discharging ability is kept, reducing the discharge degradation.

[Shapes of Non-Electroconductive Fibers in Net-Like Structural Body Layer]

The non-electroconductive fibers forming the surface layer including the net-like structural body according to the present invention can have a length longer than 100 times the fiber diameter. From observation of the surface layer including the net-like structural body with an optical microscope, etc., it can be verified whether the fiber length is longer than 100 times the fiber diameter. The fiber can have any cross-sectional shape, such as a circular, oval, rectangular, polygonal, or semicircular shape. The fiber may have different shapes in any cross-sections. The fiber diameter indicates the diameter of a circle in a cross-section of a fiber if the fiber has a cylindrical shape, and indicates the length of the longest straight line passing through the center of gravity in a cross-section of a fiber if the fiber has a non-cylindrical shape.

For the fiber diameter of the non-electroconductive fibers, the average fiber diameter d can be 0.2 μm or more and 15 μm or less. An average fiber diameter d of 15 μm or less ensures a large surface area relative to the amount of the resin forming the fibers to increase the charging quantity and thus the discharging ability. Moreover, a surface area sufficiently ensured facilitates heat diffusion to the outside of the fibers if the discharge energy is converted into heat, preventing deformation of the fibers caused by abnormal accumulation of heat or degradation of the material forming the fibers. The average fiber diameter d is more preferably 2.5 μm or less, still more preferably 1.5 μm or less. An average fiber diameter d of 2.5 μm or less reduces abnormal accumulation of heat. At an average fiber diameter d of 1.5 μm or less, abnormal accumulation of heat is almost negligible. On the other hand, an average fiber diameter d of 0.2 μm or more can keep the molecular weight of the resin forming the centers of the fibers even if the polymer forming the portion of the surface of the fiber has a significantly reduced molecular weight, thereby preventing deformation of the fiber and thus discharge degradation. The average fiber diameter d is more preferably 0.3 μm or more, still more preferably 0.4 μm or more.

The average fiber diameter d can be verified from direct observation of the fibers by optical microscope, laser microscope, or scanning electron microscope (SEM) measurement. In the present invention, the surface of the surface layer including the net-like structural body according to the present invention is observed with an SEM, and fiber diameters of any hundred fibers are measured. The average of the fiber diameters of any hundred fibers is the average fiber diameter d in the present invention.

[Interfiber Distance of Net-Like Structural Body]

At least part of the net-like structural body can be present within any square region having 200 μm sides in observation of the surface of the electroconductive member.

If the surface layer including the net-like structural body have an appropriate interfiber distance, the charging quantity during application of voltage to the electroconductive member is increased to ensure the discharging ability. Moreover, stable discharge is achieved because discharging is performed mainly from the net-like structural body and discharging sites are dispersed to reduce the size of discharge. In contrast, an excessively large interfiber distance increases the opportunity of discharge from the electroconductive substrate. In this case, the interface between the electroconductive substrate and the net-like structural body may receive excessively large discharge energy, reducing the adhesion at the interface in some cases. An influence of such a reduction in adhesion caused in one site further increases the opportunity of discharge from the electroconductive substrate, leading to the reduced adhesion in many sites. As a result, the net-like structure may change to reduce the surface area, causing discharge degradation in some cases. Accordingly, the interfiber distance in the surface layer including the net-like structural body can be 200 μm or less. To achieve an interfiber distance of 200 μm or less, at least part of the net-like structural body is present within any square region having 200 μm sides in observation of the surface of the electroconductive member. Specifically, any 100 square regions having 200 μm sides (length: 200 μm, width: 200 μm) are measured in observation of the surface of the surface layer including the net-like structural body in the vertical direction with an optical microscope or laser microscope, etc. The requirement is satisfied if at least part of the net-like structural body can be verified in all the 100 sites measured. The image to be observed has integrated information of all the segments of information of the surface layer including the net-like structural body in the thickness direction. It is considered that the method of determination described above can be used without problem because the interfiber distance on the surface of the surface layer including the net-like structural body containing the information in the thickness direction affects the effect of reducing the discharge degradation.

In the observation of the surface of the electroconductive member, at least part of the net-like structural body is more preferably present within any square region having 100 μm sides. In a configuration in which at least part of the net-like structural body is observed within any square region having 100 μm sides, a reduction in adhesion between the net-like structural body and the electroconductive substrate is prevented. Moreover, mutual complementation of the fibers forming the net-like structure inhibits a change in the net-like structure, further reducing the discharge degradation.

[Thickness of Surface Layer Including Net-Like Structural Body]

For the thickness of the surface layer including the net-like structural body, the surface layer including the net-like structural body can have an average layer thickness t of 1 μm or more and 50 μm or less. An average layer thickness t of 1 μm or more can allow the polymer forming the internal portions of the fibers to keep the molecular weight even if the polymer forming the surface of the fibers has a reduced molecular weight caused by discharge; as a result, the fibers keep their shapes. The net-like structural body is thereby kept, reducing the discharge degradation. In contrast, at a large average layer thickness t, part of the net-like structural body may exhibit the same action as that of a film without any voids to locally cause large discharge around the same; in this case, energy may locally concentrate to generate a rapid reduction in molecular weight. Such a rapid reduction in molecular weight attributed to the discharge failure caused by the electroconductive member acting as an insulator may result in deformation of the net-like structure, and thus discharge degradation. However, an average layer thickness t of 50 μm or less can prevent the generation of these failures. The average layer thickness t is more preferably 1 μm or more and 30 μm or less, still more preferably 2 μm or more and 20 μm or less. Particularly, an average layer thickness t of 30 μm or less further enhances the effect of keeping voids in the net-like structural body, preventing a local reduction in molecular weight.

The thickness of the surface layer including the net-like structural body indicates the thickness of the surface layer including the net-like structural body measured vertical to the surface of the electroconductive substrate. The thickness indicates the thickness of the region containing the non-electroconductive fibers in the member for use irrespective of whether the member is in contact or non-contact with another member. The thickness can be measured as follows: A cross-section including the electroconductive substrate and the surface layer including the net-like structural body is cut from the electroconductive member, and is measured by X-ray CT measurement. The average layer thickness t indicates the average of the thicknesses at 25 sites in total where the electroconductive member is divided into five in the longitudinal direction, and the thickness is measured at any five sites in the five divisions.

[Method of Forming Surface Layer Including Net-Like Structural Body]

Examples of the method of forming the surface layer including the net-like structural body include, but should not be limited to, the following method: Fibers are produced from a raw material solution for fibers by electrospinning (electric field spinning/electrostatic spinning), composite spinning, polymer blend spinning, melt blow spinning, flash spinning, or the like and the produced fibers are laminated on the surface of the electroconductive substrate. The fibers thus produced all have a sufficient length relative to the fiber diameter. Electrospinning is a method for producing fibers in which a high voltage is applied between the raw material solution and a collector electrode included in a syringe to charge the solution extruded from the syringe, and the solution is scattered in the electric field into thin lines, which adhere to the collector as fibers.

Figure 2:
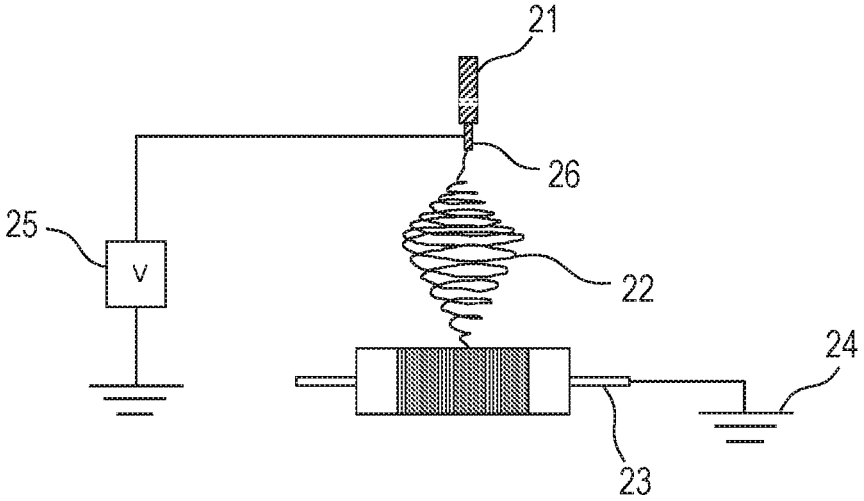
FIG. 2 is a schematic view illustrating one example of an electrospinning apparatus used in production of the electrophotographic electroconductive member according to the present invention.

Among these methods of forming the surface layer including the net-like structural body, electrospinning can be used. In other words, the method of producing the electrophotographic electroconductive member according to the present invention may include forming a surface layer including a net-like structural body by electrospinning. One example of the method of forming the surface layer including the net-like structural body by electrospinning will be described with reference to FIG. 2. As illustrated in FIG. 2, an electrospinning apparatus includes a high pressure power supply 25, a raw material solution storage tank 21, and a spinneret 26. A collector 23 mounted on the apparatus is usually earthed to the ground 24. The raw material solution is extruded from the tank 21 to the spinneret 26 at a predetermined rate. A voltage of 1 to 50 kV is applied to the spinneret 26. When the electric attraction exceeds the surface tension of the raw material solution, a jet 22 of the raw material solution is injected toward the collector 23. The raw material solution can be a raw material solution containing a solvent and a resin melted by heating a resin material to a temperature equal to or more than the melting point. If the raw material solution is a raw material solution containing a solvent, the solvent in the jet 22 gradually volatilizes. In this process, the charge per unit volume in the raw material solution increases; therefore, the solution may be more finely split, and travel to the collector in some cases. When the jet reaches the collector 23, the jet has a size reduced to a nano level.

As illustrated in FIG. 2, if an electroconductive substrate is used as the collector 23, an electroconductive member including a surface layer including a net-like structural body formed on the outer peripheral surface of the electroconductive substrate can be directly produced. An electroconductive substrate earthed to the ground reduces local unevenness of the potential on the surface thereof to form a homogeneous net-like structural body. Such a method of directly forming the surface layer including the net-like structural body on the surface of the electroconductive substrate can form a homogeneous net-like structural body having reduced unevenness in density and thickness, compared to the method of winding deposited fibrous materials around the surface of the electroconductive substrate. In preparation of fibers by electrospinning, the fibers traveling toward the collector are charged. For this reason, a plurality of the fibers are deposited with forming angles by each other due to the electrostatic force derived from the charges of the fibers. Such deposition of the fibers is advantageous in maintenance of the fiber diameter and the formation of voids.

The raw material solution used in electrospinning can be appropriately prepared by any known method. The raw material solution can contain any type of solvent in any content as long as the raw material solution is optimal for electrospinning. To homogeneously form the surface layer including the net-like structural body on the outer peripheral surface of the electroconductive substrate, the spinneret and the electroconductive substrate may be relatively moved in any direction, or the electroconductive substrate may be rotated. In this case, the orientation of fibers is reduced by setting the fiber forming rate higher than the relative moving rate between the spinneret and the surface of the electroconductive substrate facing the spinneret. Such fibers having reduced orientation can enhance the flexibility of the surface layer including the net-like structural body, and have high adhesiveness during expansion and contraction of the fibers due to the temperature and/or humidity. The fiber forming rate indicates the length of a fiber formed on the electroconductive substrate per unit time.

(Process Cartridge)

The process cartridge according to one aspect of the present invention is configured to be detachably attachable to the body of an electrophotographic image forming apparatus, and includes the electroconductive member according to one aspect of the present invention.

Figure 3:
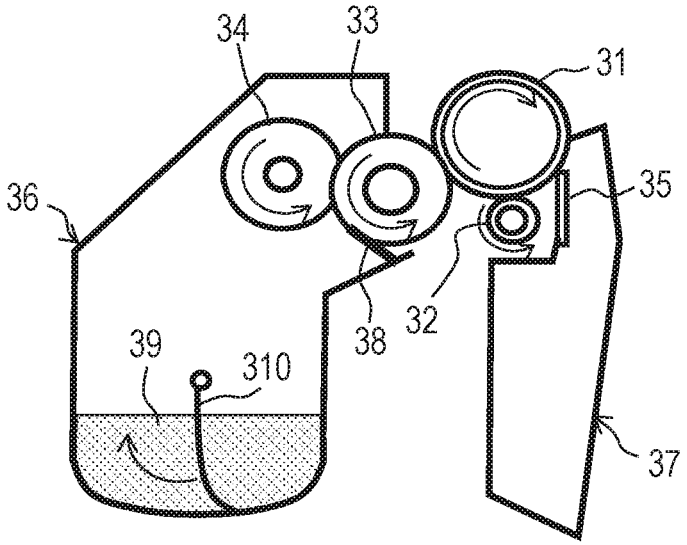
FIG. 3 is a sectional view illustrating one example of the process cartridge according to the present invention.

One example of the process cartridge is illustrated in FIG. 3. The process cartridge illustrated in FIG. 3 includes a developing apparatus and a charging apparatus. The developing apparatus includes a developing roller 33, and a toner container 36 accommodating the toner 39. The developing apparatus may include a toner feed roller 34, a developing blade 38, and a stirring blade 310 when necessary.

The charging apparatus includes a photosensitive drum 31, a cleaning blade 35, and a charging roller 32. The charging apparatus may further include a toner waste container 37.

A voltage is each to be applied to the charging roller 32, the developing roller 33, the toner feed roller 34, and the developing blade 38. The electroconductive member according to one aspect of the present invention can be used for any of the charging roller 32, the developing roller 33, and the toner feed roller 34. Particularly, use thereof as the charging roller 32 is suitable.

(Electrophotographic Image Forming Apparatus)

Figure 4:
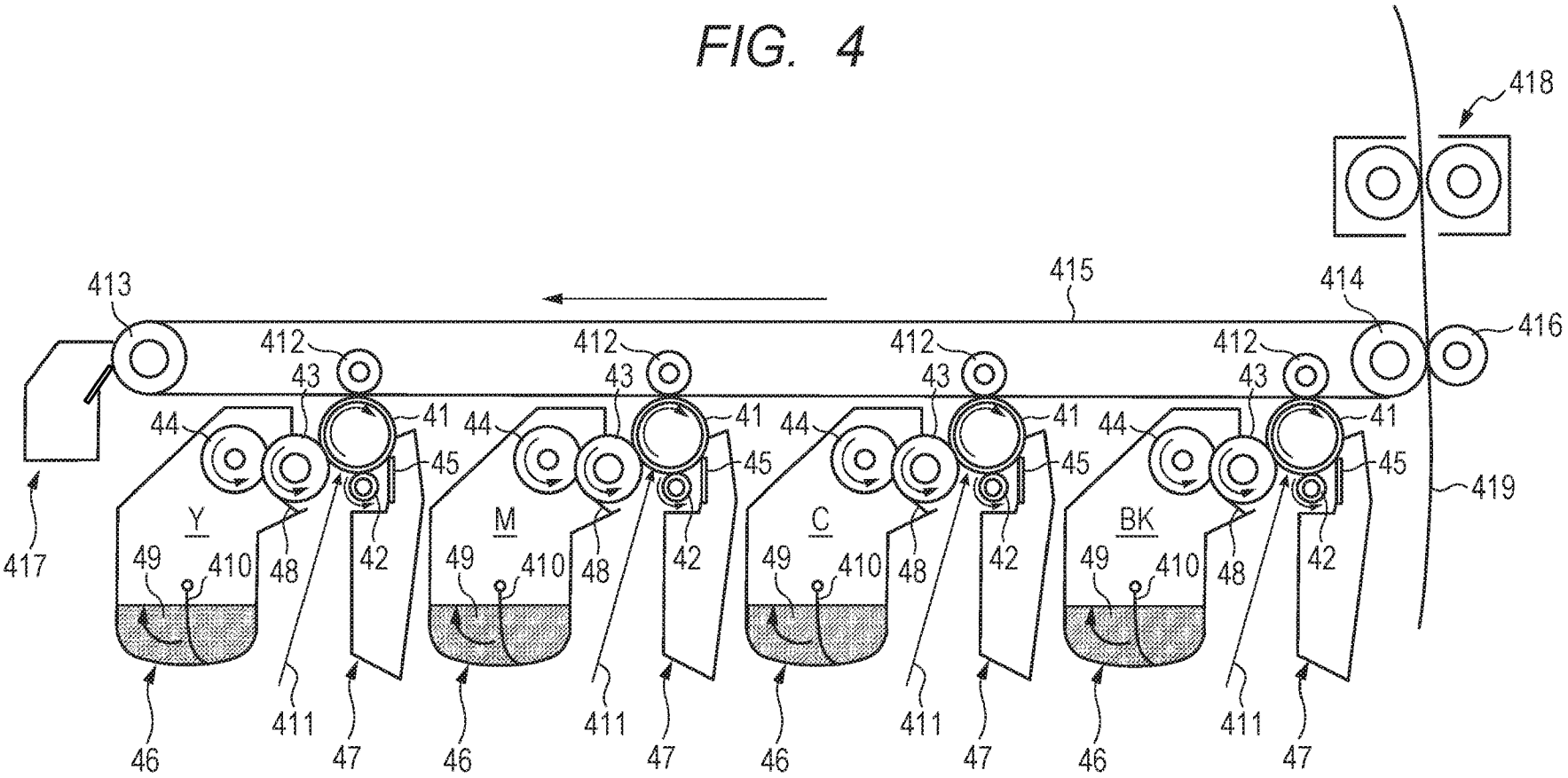
FIG. 4 is a sectional view illustrating one example of the electrophotographic image forming apparatus according to the present invention.

The electrophotographic image forming apparatus according to one aspect of the present invention includes the electroconductive member according to one aspect of the present invention. One example of the electrophotographic image forming apparatus is illustrated in FIG. 4. The electrophotographic image forming apparatus illustrated in FIG. 4 includes the process cartridges illustrated in FIG. for black (BK), magenta (M), yellow (Y), and cyan (C) toners, respectively. These cartridges are detachably attached to the color image forming apparatus.

A photosensitive drum 41 is rotated in the arrow direction to be uniformly charged by a charging roller 42 having a voltage applied from a charge bias power supply. An electrostatic latent image is formed on the surface of the photosensitive drum with exposing light 411. On the other hand, a toner 49 accommodated in a toner container 46 is fed to a toner feed roller 44 by a stirring blade 410, and is conveyed to a developing roller 43. The toner 49 is homogeneously applied onto the surface of the developing roller 43 by a developing blade 48 disposed in contact with the developing roller 43. The toner 49 is also charged by frictional charging. The electrostatic latent image is developed by the toner 49 conveyed by the developing roller 43 disposed in contact with the photosensitive drum 41 to be visualized as a toner image. The visualized toner image on the photosensitive drum 41 is transferred onto an intermediate transfer belt 415 by a primary transfer roller 412 having a voltage applied by a primary transfer bias power supply. The intermediate transfer belt 415 is driven by a tension roller 413 and an intermediate transfer belt driving roller 414. The toner images of the four colors are sequentially superimposed to form a color image on the intermediate transfer belt 415.

A transfer material 419 is fed into the apparatus by a sheet feed roller, and is conveyed between the intermediate transfer belt 415 and a secondary transfer roller 416. The secondary transfer roller 416 receives a voltage from a secondary transfer bias power supply, and transfers the color image on the intermediate transfer belt 415 onto the transfer material 419. The transfer material 419 having the color image transferred is fixed by a fixing unit 418, and is discharged to the outside of the apparatus. The print operation is then terminated.

On the other hand, the untransferred toner remaining on the photosensitive drum 41 is scrapped off from the surface of the photosensitive drum 41 by a cleaning blade 45, and is accommodated in a toner waste container 47. The cleaned photosensitive drum 41 is repeatedly used to perform the step described above. The untransferred toner remaining on the intermediate transfer belt 415 is also scrapped off by a cleaning apparatus 417.

According to one aspect of the present invention, an electrophotographic electroconductive member which can keep high discharge performance even in use under a high temperature and high humidity environment can be achieved. According to another aspect of the present invention, a process cartridge and an electrophotographic image forming apparatus which can stably form high-quality electrophotographic images are also achieved.

EXAMPLES

Example 1

[1. Preparation of Electroconductive Substrate]

The electroconductive mandrel (core metal) was prepared as an electroconductive substrate. A rod made of free cutting steel was prepared. The rod had a total length of 252 mm and an outer diameter varying stepwise. In the rod, the central region of 230 mm (excluding regions of 11 mm from both ends) had an outer diameter of 8.5 mm, and the regions of 11 mm from both ends had an outer diameter of 6 mm. In Examples, the electroconductive mandrel (core metal) was used as an electroconductive roller.

[2. Preparation of Coating Solution for Surface Layer Including Net-Like Structural Body]

<Preparation of Coating Solution 1>

Poly(tertiary butyl methacrylate) (PtBMA) (manufactured by Sigma-Aldrich Corporation, weight average molecular weight: 170000) was prepared as a material for non-electroconductive fibers.

PtBMA was dissolved in a solvent N,N-dimethylacetamide (DMAC) (manufactured by KISHIDA CHEMICAL Co., Ltd., Super grade), and the solid content was adjusted to 20% by mass to prepare Coating solution 1 for forming a surface layer.

<Preparation of Coating Solutions 2 to 25>

Coating solutions 2 to 25 were prepared in the same manner as in Coating solution 1 except that the material for non-electroconductive fibers, the solvent, and the solid content were varied as shown in Tables 1-1 and 1-2.

TABLE 1-1

| Coating solution No. | Material for fibers | Solvent | Solid content (% by mass) |
|---|---|---|---|
| 1 | PtBMA | DMAC | 20 |
| 2 | (manufactured by Sigma-Aldrich Corporation, | DMAC | 35 |
| 3 | Weight average molecular weight 170000) | DMAC | 15 |
| 4 | PMMA (manufactured by Sigma-Aldrich Corporation, Weight average molecular weight 996000) | DMAC | 13 |
| 5 | PEMA (manufactured by Sigma-Aldrich Corporation, Weight average molecular weight 850000) | DMAC | 20 |
| 6 | PBMA (manufactured by Sigma-Aldrich Corporation, Weight average molecular weight 337000) | DMAC | 20 |
| 7 | PiBMA (manufactured by Sigma-Aldrich Corporation, Weight average molecular weight 300000) | DMAC | 20 |
| 8 | PiPMA (manufactured by Sigma-Aldrich Corporation, Weight average molecular weight 100000) | DMAC | 20 |
| 9 | P(B-iB)MA (manufactured by Sigma-Aldrich Corporation, Weight average molecular weight 354000) | DMAC | 40 |
| 10 | P(B-E)MA (manufactured by Sigma-Aldrich Corporation, Weight average molecular weight 150000) | DMAC | 25 |
| 11 | PCMA (manufactured by Sigma-Aldrich Corporation, Weight average molecular weight 65000) | Mixed solvent (mass ratio of chlorobenzene:DMAC = 1:1) | 30 |
| 12 | PIB (manufactured by Sigma-Aldrich Corporation, Weight average molecular weight 1000000) | Chlorobenzene | 2.5 |
| 13 | PMS (manufactured by Sigma-Aldrich Corporation, Weight average molecular weight 150000) | DMAC | 15 |

TABLE 1-2

| Coating solution No. | Material for fibers | Solvent | Solid content (% by mass) |
|---|---|---|---|
| 14 | Chitosan (manufactured by Sigma-Aldrich Corporation) | HFIP | 13 |
| 15 | Cellulose (manufactured by Sigma-Aldrich Corporation) | HFIP | 15 |
| 16 | Cellulose acetate (manufactured by Sigma-Aldrich Corporation, Weight average molecular weight 50000) | DMAC | 25 |
| 17 | POM (manufactured by Asahi Kasei Corporation, trade name: TENAC) | HFIP | 10 |

TABLE 1-2-continued

| Coating solution No. | Material for fibers | Solvent | Solid content (% by mass) |
|---|---|---|---|
| 18 | PMMA (manufactured by Sigma-Aldrich Corporation, Weight average molecular weight 20000) | DMAC | 50 |
| 19 | PMMA (manufactured by Sigma-Aldrich Corporation, Weight average molecular weight 50000) | DMAC | 50 |
| 20 | PMMA (manufactured by Sigma-Aldrich Corporation, Weight average molecular weight 150000) | DMAC | 50 |
| 21 | PMMA (manufactured by Sigma-Aldrich Corporation, Weight average molecular weight 350000) | DMAC | 20 |
| 22 | PMMA (manufactured by Sigma-Aldrich Corporation, Weight average molecular weight 2480000) | DMAC | 5 |
| 23 | PS (manufactured by Sigma-Aldrich Corporation, Weight average molecular weight 260000) | DMAC | 30 |
| 24 | PBenMA (manufactured by Sigma-Aldrich Corporation, Weight average molecular weight 100000) | DMAC | 40 |
| 25 | Nylon 6 (manufactured by Sigma-Aldrich Corporation, Weight average molecular weight 35000) | Formic acid | 20 |

PtBMA: Poly(tertiary butyl methacrylate) ($R_1$: —$C(CH_3)_3$);

PMMA: poly(methyl methacrylate) ($R_1$: —$CH_3$);

PEMA: poly(ethyl methacrylate) ($R_1$: —$CH_2CH_3$)

PBMA: poly(butyl methacrylate) ($R_1$: —$CH_2CH_2CH_2CH_3$);

PiBMA: poly(isobutyl methacrylate) ($R_1$: —$CH_2CH(CH_3)_2$);

PiPMA: poly(isopropyl methacrylate) ($R_1$: —$CH(CH_3)_2$);

P(B-iB)MA: butyl methacrylate-isobutyl methacrylate copolymer;

P(B-E)MA: butyl methacrylate-ethyl methacrylate copolymer;

PCMA: poly(cyclohexyl methacrylate) ($R_1$: —$C_6H_{11}$);

PIB: polyisobutylene;

PMS: poly(α-methylstyrene);

POM: polyacetal;

PS: polystyrene;

PBenMA: poly(benzyl methacrylate);

DMAC: N,N-dimethylacetamide;

HFIP: 1,1,1,3,3,3-hexafluoro-2-propanol.

[3. Preparation of Electroconductive Member]

Next, Coating solution 1 was injected by electrospinning, and the resulting microfibers were directly wound around an electroconductive roller, which was the electroconductive substrate attached as a collector. Electroconductive member 1 including a surface layer including a net-like structural body on the outer peripheral surface of the electroconductive substrate was thereby prepared.

In other words, first, an electroconductive roller was attached to an electrospinning apparatus (manufactured by MECC CO., LTD., trade name: NANON-01) as a collector. Next, Coating solution 1 was filled into a tank. The tank was disposed to have a distance of 17 cm from the end thereof to the electroconductive roller. The temperature was 33° C. and the relative humidity was 20%. The electrospinning apparatus was horizontally moved at 10 mm/s while a voltage of 22 kV was being applied to the spinneret, and Coating solution 1 was injected toward the electroconductive roller. At this time, the electroconductive roller as the collector was rotated at 50 rpm. Coating solution 1 was injected for 200 seconds to prepare electroconductive member 1 including the surface layer including the net-like structural body. In addition, a plurality of electroconductive members 1 were also prepared for evaluation. In Table 5, the number of rotations (rpm) of the collector is referred to as "the number of rotations (rpm) in ES", and the time to inject the coating solution is referred to as "ES treatment time (seconds)". These conditions are summarized in Table 5.

[4. Evaluation of Properties]

Next, the electroconductive members obtained were evaluated in the following evaluation test. The results of evaluation are summarized in Table 5.

(Evaluation 4-1. Verification of Radioactive Disintegration Properties of Non-Electroconductive Fibers)

This evaluation determines whether the resin particles forming the surface layer according to the present invention are formed of a radiation degradable resin. To verify that the resin particles are formed of a radiation degradable resin, first, the resin particles forming the surface layer were sampled from the electrophotographic electroconductive member immediately after prepared not subjected to corona discharge. The molecular weight of the resin forming the resin particles was measured by gel permeation chromatography (GPC). In the next step, the electrophotographic electroconductive member was subjected to a corona discharge treatment by a predetermined method. The resin particles forming the surface layer of the electrophotographic electroconductive member were then sampled, and the molecular weight was measured by GPC. From the difference in the molecular weight before and after the corona discharging, it was determined whether the resin contained in the resin particles was a radiation degradable resin. The details will now be described.

First, 5 mg of a sample was harvested from the surface layer of electroconductive member A1 immediately after prepared (not undergoing corona discharging). A solvent which readily dissolved the sample was selected from the group consisting of toluene, chlorobenzene, tetrahydrofuran (THF), trifluoroacetic acid, and 1,1,1,3,3,3-hexafluoro-2-propanol (HFIP) to prepare a 1% by mass sample solution. The sample extracted from the net-like structural body of electroconductive member 1 according to Example 1 was dissolved in toluene as a solvent.

The molecular weight was measured using the sample solution prepared above under the following conditions. A column was stabilized in a heat chamber at a temperature of 40° C., and as an eluent, the solvent used to dissolve the sample was passed through the column at this temperature at a flow rate of 1 mL/min. The sample solution (100 μL) was injected into the column. For the molecular weight of the sample, the molecular weight distribution of the sample was calculated from the relationship between the logarithmic values of the calibration curves created from several monodispersed polystyrene standard samples (trade name: TSK gel standard polystyrenes "0005202" to "0005211", manufactured by Tosoh Corporation) and the retention time. The GPC apparatus used was a GPC gel permeation chromatograph (trade name: HLC-8120, manufactured by Tosoh Corporation). The detector used was a differential refractive index detector (trade name: RI-8020, manufactured by Tosoh Corporation). The column used was a combination of three commercially available polystyrene gel columns (trade name: TSK-GEL SUPER HM-M, manufactured by Tosoh Corporation). The sample extracted from the net-like structural body of the electroconductive member 1 before the corona discharge treatment had a molecular weight Mw of 170000.

Subsequently, electroconductive member A1 was subjected to a corona discharge treatment using a corona discharge surface treatment apparatus (manufactured by KASUGA ELECTRIC WORKS LTD.). The corona discharge treatment was performed in an H/H environment (environment at a temperature of 30° C. and a relative humidity of 80%).

Figure 5:
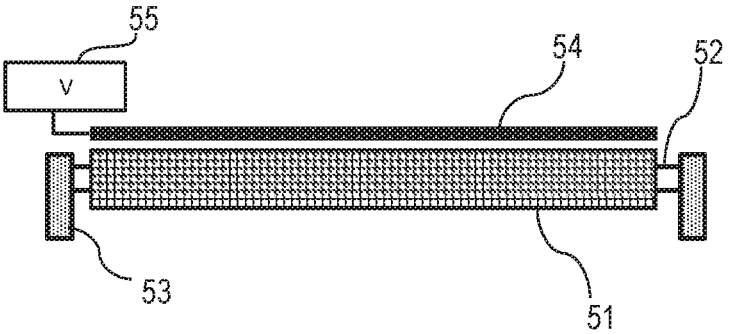
FIG. 5 is a schematic view illustrating a method of a corona discharge treatment in verification of the radioactive disintegration properties of the non-electroconductive fibers.

A method of performing a corona discharge will be described in detail with reference to FIG. 5. An electroconductive member 51 was fixed at both ends 52 thereof with supports 53. An aluminum corona electrode 54 in the longitudinal direction was disposed parallel to the longitudinal direction of the electroconductive member 51, the surface of the corona electrode 54 facing the surface of the electroconductive member 51. The distance between the surface of the corona electrode 54 and the surface of the electroconductive member 51 at their closest region was 1 mm in electroconductive member 1. The supports 53 were rotated at 30 rpm/min to rotate the electroconductive member 51, and the state where a voltage of 8 KV was applied from a power supply 55 to the electrode was continued for 2 hours. Subsequently, 5 mg of a sample was extracted from the net-like structural body of the electroconductive member 51 to measure the weight average molecular weight (Mw) by GPC using the same procedure. The sample was determined as a radiation degradable resin if the sample extracted from the electroconductive member after corona discharging had a weight average molecular weight Mw equal to or lower than that of the sample extracted from the electroconductive member before corona discharging. In contrast, the sample was determined as a radiation crosslinking if the weight average molecular weight Mw before corona discharging was larger than that after corona discharging. The net-like structural body of electroconductive member 1 contained 0% by mass of insoluble components. The weight average molecular weight Mw was 165000. Accordingly, the non-electroconductive fibers forming the net-like structural body of electroconductive member 1 were composed of a radiation degradable resin. In results of evaluation in Tables 5 to 9 described later, the case where the sample was determined as a radiation degradable resin is expressed by "Y", and the case where the sample is not a radiation degradable resin is expressed by "N".

(Evaluation 4-2. Measurement of Fiber Diameters of Non-Electroconductive Fibers)

The fiber diameters of the non-electroconductive fibers forming the surface layer including the net-like structural body were measured with a scanning electron microscope (SEM) (manufactured by Hitachi High-Technologies Corporation, trade name: S-4800, observed at 2000×). First, a slight amount of the surface layer including the net-like structural body was peeled from electroconductive member 1, and the surface of the peeled piece of the surface layer including the net-like structural body was platinum-deposited. Next, the platinum-deposited surface layer including the net-like structural body was buried in an epoxy resin. A cross-section thereof was cut out with a microtome to perform SEM observation. In the SEM observation, 100 fibers having a cross-sectional shape close to a circular shape were selected at random to measure the diameters of the fibers. The average of the fiber diameters of the 100 fibers measured was defined as an average fiber diameter d.

(Evaluation 4-3. Measurement of Volume Resistivity of Non-Electroconductive Fibers)

The volume resistivity of the non-electroconductive fibers forming the surface layer including the net-like structural body was measured with a scanning probe microscope (SPM) (manufactured by Quesant Instrument Corporation, trade name: Q-Scope 250) in a contact mode. First, the surface layer including the net-like structural body was recovered from electroconductive member 1 with a pair of tweezers, and was placed on a metal plate made of stainless steel. The measurement was performed in an environment at a temperature of 25° C. and a humidity of 50%. Next, a single fiber directly contacting the stainless steel plate was selected. The cantilever of SPM was brought into contact with the single fiber. A voltage of 50 V was applied to the cantilever to measure the current value. The resistance was calculated from the current value. Next, the volume value was calculated from the average fiber diameter d determined by the procedure described in (4-2) and the contact area with the cantilever, and the resistance was converted into a volume resistivity. The measurement described above was performed at any five points, and the average was defined as the volume resistivity of the non-electroconductive fibers.

(Evaluation 4-4. Interfiber Distance of Net-Like Structural Body)

The interfiber distance in the surface layer including the net-like structural body was measured by the following method. In electroconductive member 1, the outer surface of the surface layer including the net-like structural body was observed from the vertical direction with a laser microscope (manufactured by Keyence Corporation, trade name: VX100). In the observation with the laser microscope, 100 square regions having 100 μm or 200 μm sides were selected at random, and it was verified in each of the 100 square regions whether part of the fibers was observed or not. The interfiber distance in the surface layer including the net-like structural body was evaluated according to the following criteria:

Rank A: Part of the fibers is observed in all the 100 square regions having 100 μm sides.

Rank B: Part of the fibers is observed in all the 100 square regions having 200 μm sides.

(Evaluation 4-5. Average Layer Thickness t of Surface Layer Including Net-Like Structural Body)

The average layer thickness t of the surface layer including the net-like structural body was evaluated by the following method. Part of the surface layer including the net-like structural body of electroconductive member 1 was removed with a microtome so as to expose the electroconductive substrate from the surface. A 200× object lens was attached to the laser microscope (manufactured by Keyence Corporation, trade name: VK-X100) to observe electroconductive member 1, and the respective focal positions of the surface of the electroconductive substrate and the surface of the surface layer including the net-like structural body surface were determined. From the difference in the focal position, the thickness of the surface layer including the net-like structural body was calculated. The operation was performed at any ten sites of electroconductive member 1, and the average of the thicknesses at the ten sites obtained was defined as the average layer thickness t of the surface layer including the net-like structural body.

(Evaluation 4-6. Measurement of Glass Transition Temperature)

The glass transition temperature of the resin contained in the non-electroconductive fibers forming the surface layer including the net-like structural body was evaluated by the following method. First, because a large number of non-electroconductive fibers are needed to directly evaluate the glass transition temperature from the surface layer including the net-like structural body of electroconductive member 1, Coating solution 1 was heated at 80° C. to volatilize the solvent to prepare 3 mg of a sample for simplified evaluation. The sample was measured by differential scanning calorimetry with a differential scanning calorimeter (manufactured by Yamato Scientific Co., Ltd., trade name: DSC7020AS). The sample was left to stand at −130° C. for 30 minutes; then, the input and output of thermal energy were measured while the temperature was being varied to 250° C. at a temperature raising rate of 10° C./min. Using analysis software attached with the differential scanning calorimeter, the glass transition temperature was determined from the data obtained in the measurement. To examine the appropriateness of the glass transition temperature determined herein, 1 mg of the surface layer including the net-like structural body was peeled from a plurality of electroconductive members 1, and was measured by the same method. As a result, the same glass transition temperature was obtained. From these results, the glass transition temperature measured by differential scanning calorimetry of the sample prepared by volatilizing the solvent of Coating solution 1 as the raw material for the non-electroconductive fibers forming the surface layer including the net-like structural body was defined as the glass transition temperature of the resin contained in the non-electroconductive fibers of Electroconductive member 1. In Examples described later, the same operation was performed to determine the glass transition temperature.

(Evaluation 4-7. Determination of Crystalline Resin and Measurement of Melting Point)

The crystallinity of the non-electroconductive fibers forming the surface layer including the net-like structural body was determined through measurement of the melting point with a thermogravimetric and differential thermal analyzer (TG-DTA) (manufactured by Rigaku Corporation, trade name: TG8120). In other words, the resin showing the melting point in the measurement was determined as a crystalline resin. Specifically, the surface layer including the net-like structural body was peeled from electroconductive member 1, and was placed into a dedicated sample holder made of aluminum. The holder was placed into the analyzer. The temperature was raised from room temperature to 500° C. at a rate of 10° C./min. From the change in mass of the resin, the melting point was verified. It was determined that the resin was not crystalline if the resin decomposed without showing a clear melting point. The results of evaluation in this case are represented by a slash (/) in the value of the melting point shown in Table 5.

[Evaluation 5. Evaluation of Durability Against Discharge Degradation]

The durability of the charging ability of electroconductive member 1 was evaluated by the following method. A laser printer (manufactured by Hewlett-Packard Company, trade name: LaserJet Enterprise Color M553 dn) was prepared as an electrophotographic image forming apparatus. At this time, the output speed of the recording medium was changed to 300 mm/sec, and the image resolution was changed to 1200 dpi.

First, the charging roller was detached from the process cartridge for the laser printer, and electroconductive member 1 was attached thereto as a charging roller. The facing distance between electroconductive member 1 and the photosensitive drum was adjusted to 100 μm at the closest site.

An apparatus enabling measurement of the surface potential of the photosensitive drum was integrated into the process cartridge. The apparatus was provided with a probe (manufactured by Trek Japan K.K., trade name: Model555 P-1) connected to an electrostatic voltmeter (manufactured by Trek Japan K.K., trade name: Model347). The measurement portion of the probe was disposed facing the surface of the photosensitive drum with a distance of 1.0 mm.

The process cartridge was left to stand under an H/H environment (environment at a temperature of 30° C. and a relative humidity of 80%) for 48 hours. In the next step, the process cartridge was attached to the laser printer.

Evaluation was performed by the following method. An external power supply (trade name: Model615; manufactured by Trek Japan K.K.) was used under an H/H environment (environment at a temperature of 30° C. and a relative humidity of 80%) to apply a DC voltage of 1200 V to the core metal of electroconductive member 1, and a solid white image was output. The image was output onto 2000 sheets a day, and was again output onto 2000 sheets after 24 hours from the start of the output of the first sheet. This operation was performed for five days to output the image onto 10000 sheets in total. During this operation, the surface potential of the photosensitive drum was continuously measured. The difference ($\Delta Vd_{1200}$) between the surface potential of the photosensitive drum in the image output onto the first sheet and that in the image output onto the 10000th sheet was determined as an amount of degradation potential.

In Table 9 (described later) showing the results of evaluation, the cases where the surface of the photosensitive drum could not be charged during the image output onto the first sheet because of insufficient discharge from the electroconductive member was evaluated as "NW" (Not Worked).

If $\Delta Vd_{1200}$ was 10 V or less under an applied voltage of 1200 V in the evaluation, the same evaluation as above was subsequently performed except for an applied voltage of 1500 V to determine the amount of degradation potential ($\Delta Vd_{1500}$). In Table 9 (described later) showing the results of evaluation, "-" (hyphen) represents no measurement of $\Delta Vd_{1500}$ in Comparative Examples.

[Evaluation 6. Evaluation of Change in Volume Resistivity in Evaluation of Durability]

To verify a change in the material for the net-like structural body, a change in volume resistivity before and after the evaluation of durability at 1200 V in [5] was measured. After the evaluation of durability at 1200 V, similar to [4-3], the volume resistivity was measured under an environment at a temperature of 25° C. and a humidity of 50%. From the result, the reduction rate (%) was calculated from the evaluation in [4-3]. A two-digit or higher-digit drop of the volume resistivity indicates a reduction rate of 99% or more. Such a case is represented by "99-" in Table 9 (described later) showing the results of evaluation.

[Evaluation 7. Evaluation of Change in Surface Area in Evaluation of Durability]

In the electroconductive member evaluated for the durability at 1500 V in [5], the durability of the shape of the net-like structural body was verified by the following method. In other words, a change in the surface area before and after the evolution of durability at 1500 V was examined from image analysis. The electroconductive members undergoing the evaluation [5] only at 1200 V but not 1500 V were not subjected to this evaluation, and are represented by -(hyphen).

Image analysis was performed with a laser microscope (manufactured by Keyence Corporation, trade name: VK-X100). Before the evaluation [5], region images of 280 μm×210 μm on the surface of electroconductive member 1 were taken at 100 regions by the laser microscope equipped with a 50× object lens. Subsequently after the evaluation [5], the surface of electroconductive member 1 were photographed at 100 regions in the same manner. The surface area was calculated in consideration of the information of the image in the depth direction using the image analysis software attached to the laser microscope to determine the proportion of the surface area to the area of 280 μm×210 μm (surface area/area). The value is referred to as $S/S_0$. The proportion (%) of a reduction in $S/S_0$ before and after the evaluation of durability was calculated.

Examples 2 to 22

A plurality of electroconductive members 2 to 22 were prepared in the same manner as in Example 1 except that the coating solution and the conditions on formation were varied as Tables 5 to 7 in the formation of the surface layer including the net-like structural body, and were evaluated in the same manner as in Example 1. The results of evaluation are shown in Tables 5 to 7.

Example 23

Electroconductive member 23 was prepared in the same manner as in Example 1 except that the electroconductive substrate used was a copper rod not subjecting electroless nickel plating, and were evaluated in the same manner as in Example 1. The results of evaluation are shown in Table 7.

Example 24

Electroconductive member 24 was prepared in the same manner as in Example 1 except that the electroconductive substrate used was an aluminum rod not subjecting electroless nickel plating, and were evaluated in the same manner as in Example 1. The results of evaluation are shown in Table 7.

Examples 25 and 26

The types and amounts of materials shown in Table 3 were mixed with a pressurized kneader to prepare an A-kneaded rubber composition. Furthermore, the A kneaded rubber composition (166 parts by mass) was mixed with the types and amounts of materials shown in Table 2 with an open roll mill to prepare a B-kneaded rubber composition.

TABLE 2

| | Material | Amount compounded (parts by mass) |
|---|---|---|
| Crosslinking agent | Sulfur | 1.2 |
| Vulcanization accelerator | Tetrabenzylthiuram disulfide (Trade name: TBZTD, manufactured by Sanshin Chemical Industry Co., Ltd.) | 4.5 |

TABLE 3

| | Material | Amount compounded (parts by mass) |
|---|---|---|
| Raw material rubber | NBR (Trade name: Nipol DN219, manufactured by ZEON Corporation) | 100 |
| Electro-conductive agent | Carbon black (Trade name: TOKABLACK#7360SB, manufactured by Tokai Carbon Co., Ltd.) | 40 |
| Filler | Calcium carbonate (Trade name: NANOX#30, manufactured by Maruo Calcium Co., Ltd.) | 20 |
| Vulcanization accelerator | Zinc oxide | 5 |
| Processing aid | Stearic acid | 1 |

A rod composed of free cutting steel having a surface subjected to electroless nickel plating (total length: 252 mm, outer diameter: 6 mm) was prepared. Next, an adhesive was applied to the entire circumference of the rod excluding regions ranging 11 mm from both ends (i.e., the region having a longitudinal length of 230 mm). The adhesive used was of a conductive hot-melt type. The adhesive was applied using a roll coater. The rod coated with the adhesive was used as an electroconductive mandrel (core metal). An electroconductive resin layer was formed on the surface of the core metal by the following method. A crosshead extruder including an electroconductive mandrel feed mechanism and an unvulcanized rubber roller ejecting mechanism was prepared. To the crosshead, a die having an inner diameter of 12.5 mm was attached. The extruder and the crosshead were adjusted to 80° C., and the electroconductive mandrel conveyance rate was adjusted to 60 mm/sec. The B-kneaded rubber composition was fed from the extruder under these conditions, and a layer of the B-kneaded rubber composition was formed on the outer peripheral surface of the electroconductive mandrel in the crosshead to prepare an unvulcanized rubber roller. Next, the unvulcanized rubber roller was placed into a hot air vulcanization furnace at 170° C., and was heated for 60 minutes to prepare an unpolished electroconductive roller. Subsequently, ends of the layer were cut off. Finally, the surface of the layer was polished with a rotary grinding wheel. An electroconductive roller was thereby prepared that had a diameter of 8.4 mm in the regions ranging 90 mm from the central portion to both ends and a central diameter of 8.5 mm.

A plurality of electroconductive members 25 and 26 were prepared in the same manner as in Example 1 except that the electroconductive roller was used as an electroconductive substrate and the coating solution and the conditions on formation were varied as shown in Table 7, and were evaluated in the same manner as in Example 1. The results of evaluation are shown in Table 7.

Examples 27 and 28

An electroconductive resin layer was formed on the core metal used in Examples 25 and 26 as follows. An electroconductive roller was prepared by the same operation as that in Examples 25 and 26 using an unvulcanized rubber composition prepared through mixing of the materials shown in Table 4 with an open roll mill.

TABLE 4

| Material | Amount compounded (parts by mass) |
|---|---|
| Epichlorohydrin-ethylene oxide-allyl glycidyl ether terpolymer (GECO) (Trade name: EPICHLOMER CG-102, manufactured by Daiso Co., Ltd.) | 100 |
| Zinc oxide(Two types of zinc oxides, manufactured by Seido Chemical Industry Co., Ltd.) | 5 |
| Calcium carbonate (Trade name: Silver-W, manufactured by Shiraishi Calcium Kaisha, Ltd.) | 35 |
| Carbon black (Trade name: SEAST SO, manufactured by Tokai Carbon Co., Ltd.) | 0.5 |
| Stearic acid | 2 |
| Adipic acid ester (Trade name: POLYCIZER W305ELS, manufactured by DIC Corporation) | 10 |
| Sulfur | 0.5 |
| Dipentamethylenethiuram tetrasulfide (Trade name: NOCCELER TRA, manufactured by Ouchi Shinko Chemical Industrial Co., Ltd.) | 2 |
| Cetyltrimethylammonium bromide | 2 |

A plurality of electroconductive members 27 and 28 were prepared in the same manner as in Example 1 except that the electroconductive roller was used as an electroconductive substrate and the coating solution and the conditions on formation were varied as shown in Table 7, and were evaluated in the same manner as in Example 1. The results of evaluation are shown in Table 7.

Examples 29 to 31

The following operation was performed to prepare poly (tertiary butyl methacrylate) (PtBMA) having a low molecular weight. Tertiary butyl acrylate (tBMA) (20 g, 0.156 mol), 2-bromomethyl propionate (MBrP) (0.087 ml, 5.2 mmol), hexamethylene triethylene tetraamine (HMTETA) (0.638 ml, 2.34 mmol), and N,N-dimethylformamide (DMF) (5.4 g) were mixed. Dissolved oxygen was removed by bubbling the mixture with nitrogen for 10 minutes. Copper bromide (I) (0.336 g, 2.34 mmol) was then added to the solution, and bubbling with nitrogen was further performed for 10 minutes. A three-way stopcock was closed to perform a polymerization reaction using an oil bus at 70° C. The reaction system was a homogenous system having a color of green, and the viscosity increased with progression of the reaction. After 3 hours, the flask was extracted from the oil bus, and was quenched with liquid nitrogen to terminate the polymerization reaction. The polymerization product was diluted with acetone (polymer content: about 20% by mass), and the catalyst residue was removed through an alumina column. The product was then reprecipitated in methanol/water (1/1, v/v) cooled to 0° C. to be refined. The reprecipitated recovered product was further dissolved in diethyl ether to be reprecipitated in methanol/water (1/1, v/v). This operation was repeated three times to remove the unreacted monomer. A macroinitiator (PtBMA-Br) having bromine (Br) at the terminal was thereby yielded as a white solid. The yield of PtBMA-Br was 14.7 g, and the weight average molecular weight (Mw) determined by GPC measurement was 5000.

The white solid was added to Coating solution 1 such that the content of PtBMA-Br was 5% by mass, 10% by mass, and 15% by mass relative to PtBMA in Coating solution 1. A plurality of electroconductive members 29, 30, and 31 were prepared in the same manner as in Example 1 except that the coating solution was used and the conditions on formation were varied as shown in Table 8, and were evaluated in the same manner as in Example 1. The results of evaluation are shown in Table 8. In the measurement (GPC) of the molecular weight to verify the radiation degradable resin, analysis was performed focusing only the components having a molecular weight of 10000 or more.

Example 32

PMMA having a weight average molecular weight of 4000 (manufactured by Sigma-Aldrich Corporation) was added to Coating solution 4 such that the content was 5% by mass relative to the resin component (PMMA having a weight average molecular weight of 996000). A plurality of electroconductive members 32 were prepared in the same manner as in Example 1 except that the coating solution was used and the conditions on formation were varied as shown in Table 8, and were evaluated in the same manner as in Example 1. The results of evaluation are shown in Table 8. In the measurement (GPC) of the molecular weight to verify the radiation degradable resin, analysis was performed focusing only the components having a molecular weight of 10000 or more.

Examples 33 and 34

A radical scavenger p-hydroquinone (manufactured by Sigma-Aldrich Corporation) was added to Coating solution 1 and Coating solution 17 such that the content was 5% by mass relative to the resin component. A plurality of electroconductive members 33 and 34 were prepared in the same manner as in Example 1 except that the coating solution was used and the conditions on formation were varied as shown in Table 8, and were evaluated in the same manner as in Example 1. The results of evaluation are shown in Table 8.

Comparative Examples 1 to 3

A plurality of electroconductive members 35 to 37 were prepared in the same manner as in Example 1 except that the coating solution and the conditions on formation were varied as shown in Table 9 in formation of the surface layer including the net-like structural body, and were evaluated in the same manner as in Example 1. The results of evaluation are shown in Table 9. The resin component contained in the coating solution used in Comparative Examples 1 to 3 was a radiation crosslinking resin, which does not satisfy the requirements according to one aspect of the present invention. In Comparative Examples 1 to 3, $\Delta V_d$ was significantly large, and discharge degradation was caused.

Comparative Example 4

A plurality of electroconductive members 38 were prepared in the same manner as in Example 1 except that the electroconductive mandrel was coated with a commercially available metal wire (copper wire having a diameter of 10 μm, manufactured by Elektrisola Inc.) in preparation of electroconductive member 38, and were evaluated in the same manner as in Example 1. The results of evaluation are shown in Table 9. The surface layer including the net-like structural body in Comparative Example 4 was composed of electroconductive fibers, which do not satisfy the requirements of the present invention. In Comparative Example 4, discharge did not occur in the evaluation of durability against discharge degradation, and thus the photosensitive drum was not charged.

Comparative Example 5

A plurality of electroconductive members 39 were prepared in the same manner as in Example 1 except that a coating solution containing 15 parts by mass of carbon black (HAF) relative to 100 parts by mass of the solid content of Coating solution 4 was used and the conditions on formation were varied as shown in Table 9, and were evaluated in the same manner as in Example 1. The results of evaluation are shown in Table 9. The surface layer including the net-like structural body in Comparative Example 5 was composed of electroconductive fibers, which do not satisfy the requirements of the present invention. In Comparative Example 5, the photosensitive drum was not charged.

TABLE 5

| | Example 1 | Example 2 | Example 3 | Example 4 | Example 5 | Example 6 | Example 7 | Example 8 | Example 9 | Example 10 |
|---|---|---|---|---|---|---|---|---|---|---|
| Electroconductive substrate | | | | | | | | | | |
| Core metal | Free cutting steel | Free cutting steel | Free cutting steel | Free cutting steel | Free cutting steel | Free cutting steel | Free cutting steel | Free cutting steel | Free cutting steel | Free cutting steel |
| Electroconductive resin layer | None | None | None | None | None | None | None | None | None | None |
| Surface layer composed of net-like structural body | | | | | | | | | | |
| Coating solution | Coating solution 1 | Coating solution 2 | Coating solution 3 | Coating solution 4 | Coating solution 5 | Coating solution 6 | Coating solution 7 | Coating solution 8 | Coating solution 9 | Coating solution 10 |
| Number of rotations in ES (rpm) | 50 | 50 | 50 | 500 | 50 | 50 | 50 | 50 | 50 | 50 |
| ES treatment time (seconds) | 200 | 200 | 60 | 200 | 200 | 200 | 200 | 200 | 100 | 200 |
| Voltage applied (KV) | 22 | 22 | 22 | 22 | 22 | 22 | 22 | 22 | 22 | 22 |
| Ejection rate (ml/h) | 0.5 | 0.5 | 0.5 | 0.5 | 0.5 | 0.5 | 0.5 | 0.5 | 0.5 | 0.5 |
| Heat treatment temperature (° C.) | 120 | 120 | 120 | 120 | 70 | 35 | 70 | 100 | 50 | 70 |
| Heat treatment time (hours) | 2 | 2 | 2 | 2 | 2 | 2 | 2 | 2 | 2 | 2 |
| Weight average molecular weight Mw | 170000 | 170000 | 170000 | 980000 | 850000 | 330000 | 300000 | 100000 | 350000 | 150000 |
| Glass transition temperature (° C.) | 107 | 107 | 107 | 110 | 63 | 15 | 55 | 80 | 35 | 52 |
| Melting point (° C.) | / | / | / | / | / | / | / | / | / | / |
| Average fiber diameter (μm) | 0.97 | 1.45 | 0.97 | 0.5 | 0.8 | 0.84 | 1.04 | 0.87 | 1.45 | 0.81 |
| Average layer thickness (μm) | 7 | 8 | 1 | 7 | 5 | 3 | 6 | 6 | 10 | 10 |
| Interfiber distance | A | A | B | A | A | A | A | A | A | A |
| Volume resistivity (Ωcm) | $1 \times 10^{14}$ | $1 \times 10^{14}$ | $1 \times 10^{14}$ | $1 \times 10^{15}$ | $1 \times 10^{14}$ | $1 \times 10^{13}$ | $1 \times 10^{12}$ | $1 \times 10^{13}$ | $1 \times 10^{11}$ | $1 \times 10^{5}$ |
| Verification of radioactive disintegration properties | | | | | | | | | | |
| Change in weight average molecular weight Mw | Reduced | Reduced | Reduced | Reduced | Reduced | Reduced | Reduced | Reduced | Reduced | Reduced |
| Determination of type | Y | Y | Y | Y | Y | Y | Y | Y | Y | Y |
| Evaluation of durability against discharge degradation | | | | | | | | | | |
| Volume resistivity reduction rate (%) | 0 | 0 | 0 | 5 | 10 | 15 | 4 | 2 | 11 | 8 |
| ΔVd1200 (V) | 0 | 0 | 0 | 8 | 16 | 24 | 18 | 9 | 20 | 18 |
| ΔVd1500 (V) | 1 | 1 | 2 | 11 | 24 | 38 | 11 | 9 | 24 | 28 |
| Change in surface area S/So (%) | 2 | 2 | 3 | 2 | 8 | 18 | 9 | 6 | 12 | 9 |

TABLE 6

| | Example 11 | Example 12 | Example 13 | Example 14 | Example 15 | Example 16 | Example 17 | Example 18 | Example 19 | Example 20 |
|---|---|---|---|---|---|---|---|---|---|---|
| Electroconductive substrate | | | | | | | | | | |
| Core metal | Free cutting steel | Free cutting steel | Free cutting steel | Free cutting steel | Free cutting steel | Free cutting steel | Free cutting steel | Free cutting steel | Free cutting steel | Free cutting steel |

TABLE 6-continued

| | Example 11 | Example 12 | Example 13 | Example 14 | Example 15 | Example 16 | Example 17 | Example 18 | Example 19 | Example 20 |
|---|---|---|---|---|---|---|---|---|---|---|
| Electroconductive resin layer | None | None | None | None | None | None | None | None | None | None |
| Surface layer composed of net-like structural body | | | | | | | | | | |
| Coating solution | Coating solution 11 | Coating solution 12 | Coating solution 13 | Coating solution 14 | Coating solution 15 | Coating solution 16 | Coating solution 17 | Coating solution 18 | Coating solution 19 | Coating solution 20 |
| Number of rotations in ES (rpm) | 50 | 50 | 50 | 50 | 50 | 50 | 50 | 500 | 500 | 500 |
| ES treatment time (seconds) | 200 | 2000 | 300 | 300 | 300 | 400 | 200 | 300 | 300 | 300 |
| Voltage applied (KV) | 17 | 25 | 22 | 22 | 20 | 25 | 19 | 15 | 16 | 16 |
| Ejection rate (ml/h) | 0.5 | 0.5 | 0.5 | 0.5 | 0.5 | 0.5 | 0.5 | 0.5 | 0.5 | 0.5 |
| Heat treatment temperature (° C.) | 120 | None | 100 | 180 | 100 | 150 | 180 | 100 | 100 | 120 |
| Heat treatment time (hours) | 2 | — | 2 | 2 | 2 | 2 | 2 | 2 | 2 | 2 |
| Weight average molecular weight Mw | 60000 | 1000000 | 150000 | 110000 | 200000 | 50000 | 600000 | 20000 | 50000 | 150000 |
| Glass transition temperature (° C.) | 104 | −70 | 165 | 180 | 115 | 160 | −50 | 90 | 100 | 100 |
| Melting point (° C.) | / | / | / | 200 | 260 | 230 | 170 | / | / | / |
| Average fiber diameter (μm) | 1.45 | 2.40 | 1.42 | 0.3 | 0.2 | 0.50 | 0.34 | 1.48 | 1.40 | 1.40 |
| Average layer thickness (μm) | 20 | 9 | 15 | 12 | 15 | 15 | 5 | 16 | 17 | 19 |
| Interfiber distance | A | A | A | A | A | A | A | A | A | A |
| Volume resistivity (Ωcm) | $1 \times 10^{14}$ | $1 \times 10^{13}$ | $1 \times 10^{13}$ | $1 \times 10^{13}$ | $1 \times 10^{13}$ | $1 \times 10^{14}$ | $1 \times 10^{14}$ | $1 \times 10^{15}$ | $1 \times 10^{15}$ | $1 \times 10^{15}$ |
| Verification of radioactive disintegration properties | | | | | | | | | | |
| Change in weight average molecular weight Mw | Reduced | Reduced | Reduced | Reduced | Reduced | Reduced | Reduced | Reduced | Reduced | Reduced |
| Determination of type | Y | Y | Y | Y | Y | Y | Y | Y | Y | Y |
| Evaluation of durability against discharge degradation | | | | | | | | | | |
| Volume resistivity reduction rate (%) | 9 | 25 | 10 | 2 | 5 | 0 | 10 | 5 | 5 | 5 |
| ΔVd1200 (V) | 15 | 50 | 8 | 3 | 8 | 0 | 17 | 8 | 8 | 8 |
| ΔVd1500 (V) | 20 | 80 | 20 | 4 | 11 | 1 | 20 | 12 | 11 | 11 |
| Change in surface area S/So (%) | 3 | 25 | 0 | 0 | 2 | 1 | 0 | 3 | 2 | 2 |

TABLE 7

| | Example 21 | Example 22 | Example 23 | Example 24 | Example 25 | Example 26 | Example 27 | Example 28 |
|---|---|---|---|---|---|---|---|---|
| Electroconductive substrate | | | | | | | | |
| Core metal | Free cutting steel | Free cutting steel | Copper | Aluminum | Free cutting steel | Free cutting steel | Free cutting steel | Free cutting steel |
| Electroconductive resin layer | None | None | None | None | NBR | NBR | Hydrin | Hydrin |
| Surface layer composed of net-like structural body | | | | | | | | |
| Coating solution | Coating solution 21 | Coating solution 22 | Coating solution 1 | Coating solution 1 | Coating solution 1 | Coating solution 4 | Coating solution 1 | Coating solution 4 |
| Number of rotations in ES (rpm) | 500 | 500 | 50 | 50 | 50 | 500 | 50 | 500 |
| ES treatment time (seconds) | 300 | 300 | 200 | 200 | 200 | 200 | 200 | 200 |
| Voltage applied (KV) | 21 | 25 | 22 | 22 | 22 | 22 | 22 | 22 |
| Ejection rate (ml/h) | 0.5 | 0.5 | 0.5 | 0.5 | 0.5 | 0.5 | 0.5 | 0.5 |
| Heat treatment temperature (° C.) | 120 | 140 | 120 | 120 | 120 | 120 | 120 | 120 |
| Heat treatment time (hours) | 2 | 2 | 2 | 2 | 2 | 2 | 2 | 2 |
| Weight average molecular weight Mw | 350000 | 2450000 | 170000 | 170000 | 170000 | 980000 | 170000 | 980000 |
| Glass transition temperature (° C.) | 110 | 115 | 107 | 107 | 107 | 110 | 107 | 110 |
| Melting point (° C.) | / | / | / | / | / | / | / | / |
| Average fiber diameter (μm) | 1.06 | 0.25 | 0.98 | 1.0 | 1.0 | 0.52 | 0.95 | 0.54 |
| Average layer thickness (μm) | 7 | 3 | 8 | 8 | 8 | 7 | 7 | 8 |
| Interfiber distance | A | A | A | A | A | A | A | A |
| Volume resistivity (Ωcm) | $1 \times 10^{15}$ | $1 \times 10^{15}$ | $1 \times 10^{14}$ | $1 \times 10^{14}$ | $1 \times 10^{14}$ | $1 \times 10^{15}$ | $1 \times 10^{14}$ | $1 \times 10^{15}$ |
| Verification of radioactive disintegration properties | | | | | | | | |
| Change in weight average molecular weight Mw | Reduced | Reduced | Reduced | Reduced | Reduced | Reduced | Reduced | Reduced |

TABLE 7-continued

| | Example 21 | Example 22 | Example 23 | Example 24 | Example 25 | Example 26 | Example 27 | Example 28 |
|---|---|---|---|---|---|---|---|---|
| Determination of type | Y | Y | Y | Y | Y | Y | Y | Y |
| Evaluation of durability against discharge degradation | | | | | | | | |
| Volume resistivity reduction rate (%) | 5 | 5 | 0 | 0 | 0 | 5 | 0 | 5 |
| ΔVd1200 (V) | 8 | 8 | 0 | 0 | 0 | 8 | 0 | 8 |
| ΔVd1500 (V) | 11 | 11 | 1 | 1 | 1 | 11 | 1 | 11 |
| Change in surface area S/So (%) | 2 | 2 | 2 | 2 | 2 | 2 | 2 | 2 |

TABLE 8

| | Example 29 | Example 30 | Example 31 | Example 32 | Example 33 | Example 34 |
|---|---|---|---|---|---|---|
| Electroconductive substrate | | | | | | |
| Core metal | Free cutting steel | Free cutting steel | Free cutting steel | Free cutting steel | Free cutting steel | Free cutting steel |
| Electroconductive resin layer | None | None | None | None | None | None |
| Surface layer composed of net-like structural body | | | | | | |
| Coating solution | Coating solution 1 + low molecular weight PtBMA-Br 5% by mass | Coating solution 1 + low molecular weight PtBMA-Br 10% by mass | Coating solution 1 + low molecular weight PtBMA-Br 15% by mass | Coating solution 4 + low molecular weight PMMA 5% by mass | Coating solution 1 + p-hydroquinone | Coating solution 17 + p-hydroquinone |
| Number of rotations in ES (rpm) | 50 | 50 | 50 | 500 | 50 | 50 |
| ES treatment time (seconds) | 200 | 200 | 200 | 200 | 200 | 200 |
| Voltage applied (KV) | 22 | 22 | 22 | 22 | 22 | 19 |
| Ejection rate (ml/h) | 0.5 | 0.5 | 0.5 | 0.5 | 0.5 | 0.5 |
| Heat treatment temperature (° C.) | 120 | 120 | 120 | 120 | 120 | 180 |
| Heat treatment time (hours) | 2 | 2 | 2 | 2 | 2 | 2 |
| Weight average molecular weight Mw | 170000 | 170000 | 170000 | 980000 | 170000 | 600000 |
| Glass transition temperature (° C.) | 107 | 107 | 107 | 110 | 107 | −50 |
| Melting point (° C.) | / | / | / | / | / | 170 |
| Average fiber diameter (μm) | 0.97 | 0.97 | 0.97 | 0.52 | 0.97 | 0.34 |
| Average layer thickness (μm) | 7 | 7 | 7 | 7 | 7 | 5 |
| Interfiber distance | A | A | A | A | A | A |
| Volume resistivity (Ωcm) | $1 \times 10^{14}$ | $1 \times 10^{14}$ | $1 \times 10^{14}$ | $1 \times 10^{15}$ | $1 \times 10^{14}$ | $1 \times 10^{14}$ |
| Verification of radioactive disintegration properties | | | | | | |
| Change in weight average molecular weight Mw | Reduced | Reduced | Reduced | Reduced | Reduced | Reduced |
| Determination of type | Y | Y | Y | Y | Y | Y |
| Evaluation of durability against discharge degradation | | | | | | |
| Volume resistivity reduction rate (%) | 0 | 0 | 0 | 3 | 0 | 8 |
| ΔVd1200 (V) | 0 | 0 | 0 | 8 | 0 | 17 |
| ΔVd1500 (V) | 0 | 0 | 0 | 7 | 0 | 15 |
| Change in surface area S/So (%) | 2 | 2 | 3 | 2 | 2 | 0 |

TABLE 9

| | Comparative Example 1 | Comparative Example 2 | Comparative Example 3 | Comparative Example 4 | Comparative Example 5 |
|---|---|---|---|---|---|
| Electroconductive substrate | | | | | |
| Core metal | Free cutting steel | Free cutting steel | Free cutting steel | Free cutting steel | Free cutting steel |
| Electroconductive resin layer | None | None | None | None | None |
| Surface layer composed of | | | | | |

TABLE 9-continued

| | Comparative Example 1 | Comparative Example 2 | Comparative Example 3 | Comparative Example 4 | Comparative Example 5 |
|---|---|---|---|---|---|
| net-like structural body | | | | | |
| Coating solution | Coating solution 23 | Coating solution 24 | Coating solution 25 | — | Coating solution 4 + carbon |
| Number of rotations in ES (rpm) | 50 | 50 | 50 | — | 50 |
| ES treatment time (seconds) | 200 | 200 | 200 | — | 200 |
| Voltage applied (KV) | 25 | 22 | 25 | — | 22 |
| Ejection rate (ml/h) | 0.5 | 0.5 | 0.5 | — | 0.5 |
| Heat treatment temperature(° C.) | 130 | 70 | 70 | — | 120 |
| Heat treatment time (hours) | 2 | 2 | 2 | — | 2 |
| Weight average molecular weight Mw | 260000 | 100000 | 35000 | — | 980000 |
| Glass transition temperature (° C.) | 100 | 54 | 50 | — | 110 |
| Melting point (° C.) | 240 | / | 225 | — | / |
| Average fiber diameter (μm) | 1.50 | 0.96 | 0.80 | 10.2 | 0.5 |
| Average layer thickness (μm) | 10 | 17 | — | 33 | 7 |
| Interfiber distance | A | A | A | A | A |
| Volume resistivity (Ωcm) | $1 \times 10^{14}$ | $1 \times 10^{14}$ | $1 \times 10^{14}$ | $1 \times 10^{-6}$ | $1 \times 10^{5}$ |
| Verification of radioactive disintegration properties | | | | | |
| Change in weight average molecular weight Mw | Increased | Increased | Increased | — | Reduced |
| Determination of type | N | N | N | — | Y |
| Evaluation of durability against discharge degradation | | | | | |
| Volume resistivity reduction rate (%) | 99– | 99– | 99– | 0 | 1 |
| $\Delta Vd_{1200}$ (V) | 140 | 110 | 120 | NW | NW |
| $\Delta Vd_{1500}$ (V) | — | — | — | — | — |
| Change in surface area S/So (%) | — | — | — | — | — |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-188486, filed Sep. 27, 2016, which is hereby incorporated by reference herein in its entirety.

What is claimed is:

1. An electrophotographic electroconductive member, comprising:

an electroconductive substrate; and a surface layer including a net structural body disposed on the electroconductive substrate, the net structural body comprising non-electroconductive fibers containing a radiation degradable resin, wherein the radiation degradable resin is an acrylic resin having a structural unit represented by formula (1):

(1)

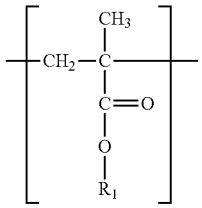

where $R_1$ is at least one member selected from the group consisting of formulae (2) and (3):

$—C(CH_3)_3$ (2); and $—CH(CH_3)_2$ (3).

2. The electrophotographic electroconductive member according to claim 1, wherein the resin has a glass transition temperature of 50 to 200° C.

3. The electrophotographic electroconductive member according to claim 1, wherein $R_1$ is $—C(CH_3)_3$.

4. The electrophotographic electroconductive member according to claim 1, wherein at least part of the net structural body is present within any square region having 200 μm sides in observation of the surface of the electrophotographic electroconductive members.

5. The electrophotographic electroconductive member according to claim 1, wherein the non-electroconductive fibers have an average fiber diameter of 0.2 to 15 μm.

6. The electrophotographic electroconductive member according to claim 1, wherein the electroconductive substrate includes a rigid structural body.

7. The electrophotographic electroconductive member according to claim 1, wherein the non-electroconductive fibers have a volume resistivity of $1\times10^8$ Ω·cm or more.

8. The electrophotographic electroconductive member according to claim 1, wherein the surface layer further comprises a radical scavenger.

9. The electrophotographic electroconductive member according to claim 1, wherein $R_1$ is $—CH(CH_3)_2$.

10. A process cartridge configured to be detachably attachable to a body of an electrophotographic image forming apparatus, the process cartridge comprising:

an electrophotographic electroconductive member comprising an electroconductive substrate, and a surface layer including a net structural body disposed on the electroconductive substrate, the net structural body comprising non-electroconductive fibers containing a radiation degradable resin, wherein the radiation degradable resin is an acrylic resin having a structural unit represented by formula (1):

(1)

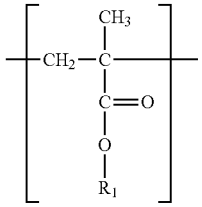

where $R_1$ is at least one member selected from the group consisting of formulae (2) and (3):

$$—C(CH_3)_3 \quad (2); \text{ and}$$

$$—CH(CH_3)_2 \quad (3).$$

11. The process cartridge according to claim 10, further comprising a photosensitive drum, wherein the electrophotographic electroconductive member is a charging member for the photosensitive drum.

12. An electrophotographic image forming apparatus, comprising an electrophotographic electroconductive member comprising an electroconductive substrate, and a surface layer including a net structural body disposed on the electroconductive substrate, the net structural body comprising non-electroconductive fibers containing a radiation degradable resin, wherein the radiation degradable resin is an acrylic resin having a structural unit represented by formula (1):

(1)

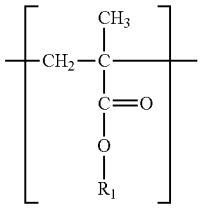

where $R_1$ is at least one member selected from the group consisting of formulae (2) and (3):

$$—C(CH_3)_3 \quad (2); \text{ and}$$

$$—CH(CH_3)_2 \quad (3).$$

13. The electrophotographic image forming apparatus according to claim 12, further comprising a photosensitive drum, wherein the electrophotographic electroconductive member is a charging member for the photosensitive drum.

* * * * *